US010747135B2

(12) United States Patent
Hotta et al.

(10) Patent No.: US 10,747,135 B2
(45) Date of Patent: Aug. 18, 2020

(54) TONER

(71) Applicant: CANON KABUSHIKI KAISHA, Tokyo (JP)

(72) Inventors: Yojiro Hotta, Mishima (JP); Koji Nishikawa, Susono (JP); Kazuo Terauchi, Numazu (JP); Takaaki Furui, Tokyo (JP); Ryo Nagata, Mishima (JP); Keisuke Tanaka, Yokohama (JP); Masami Fujimoto, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/286,402

(22) Filed: Feb. 26, 2019

(65) Prior Publication Data

US 2019/0271928 A1 Sep. 5, 2019

(30) Foreign Application Priority Data

Mar. 1, 2018 (JP) ..... 2018-036772

(51) Int. Cl.
*G03G 9/097* (2006.01)
*G03G 9/08* (2006.01)

(52) U.S. Cl.
CPC ..... *G03G 9/09708* (2013.01); *G03G 9/0819* (2013.01); *G03G 9/0827* (2013.01)

(58) Field of Classification Search
CPC . G03G 9/09708; G03G 9/0819; G03G 9/0827
See application file for complete search history.

(56) References Cited

U.S. PATENT DOCUMENTS

| | | | | |
|---|---|---|---|---|
| 4,755,373 | A * | 7/1988 | Gherardi | B82Y 30/00 423/598 |
| 2016/0004178 | A1* | 1/2016 | Sugiura | G03G 9/0806 430/105 |
| 2018/0246432 | A1* | 8/2018 | Nishikawa | G03G 9/08797 |
| 2019/0033739 | A1* | 1/2019 | Yamagishi | G03G 9/09708 |

FOREIGN PATENT DOCUMENTS

| | | |
|---|---|---|
| JP | 2010-211245 A | 9/2010 |
| JP | 2015-137208 A | 7/2015 |

* cited by examiner

*Primary Examiner* — Thorl Chea
(74) *Attorney, Agent, or Firm* — Canon U.S.A., Inc IP Division

(57) ABSTRACT

A toner including a toner particle; and an external additive, wherein the external additive contains strontium titanate particle, and when in a projected image of the strontium titanate particle photographed using a scanning electron microscope, a standard deviation of a distance from a center of the projected image to an outline of the projected image is Ds, and a circle-equivalent diameter of the projected image is Da, a value CV calculated by Equation (1) is 0.07 or less, $$CV=Ds/(Da/2) \quad (1).$$

6 Claims, 1 Drawing Sheet

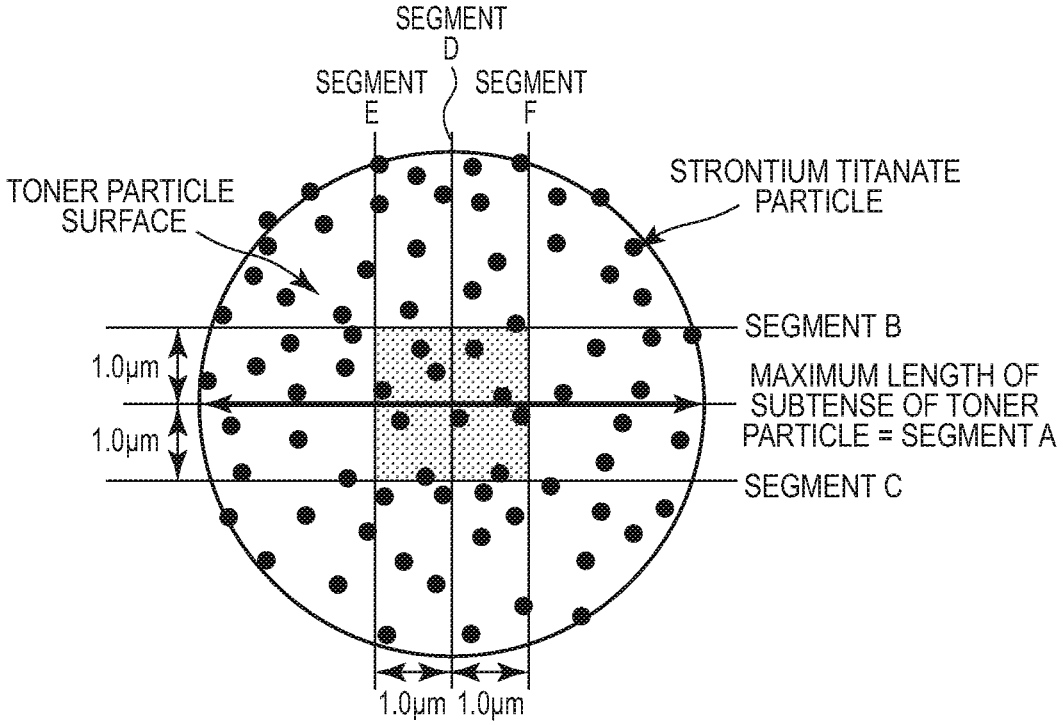
SEGMENT D
SEGMENT E
SEGMENT F
TONER PARTICLE SURFACE
STRONTIUM TITANATE PARTICLE
SEGMENT B
1.0μm
MAXIMUM LENGTH OF SUBTENSE OF TONER PARTICLE = SEGMENT A
1.0μm
SEGMENT C
1.0μm 1.0μm

TONER

BACKGROUND OF THE INVENTION

Field of the Invention

The present disclosure relates to a toner used in an image forming method such as electrophotography.

Description of the Related Art

An electrophotographic image forming device is required to be fast, have longer lifetime, save energy, and be miniaturized, and among them, for a printer for SOHO, especially miniaturization is increasingly demanded.

From the viewpoint of miniaturization, it is important to reduce consumption of toner. By reducing the consumption of toner, a volume of a toner cartridge may be reduced, and thus, further improvement is demanded. Therefore, various toners and external additives have been suggested.

In order to reduce the consumption of toner, it is important to improve transferability of toner. Therefore, as the external additive, spherical silica and the like are used as spacer particles. A toner to which spherical silica is externally added has good initial properties, however, due to the spherical shape, the spherical silica is repeatedly rubbed in a developing device to be likely to roll on the surface of toner, and there is a disadvantage in sustaining long-term stabilized transferability. In addition, since silica is a highly resistant material, while being a strong negative material, silica rolls and is unevenly distributed on the surface of toner, thereby being likely to cause local uneven distribution of charge on the surface of toner, and thus, there is still a disadvantage with transfer stability.

Accordingly, a strontium titanate particle which is a weak positive and medium resistant material has been studied. The strontium titanate particle which was conventionally used as an external additive is a hexahedral shape, and often has a flat surface. When the strontium titanate particle has a flat surface, a contact area between the strontium titanate particles is increased, whereby the strontium titanate particles are often present as aggregated particles. This results in an increased contact area with toner particles, and thus, charge is likely to be exchanged between the toner particles and the strontium titanate particles. Further, even in the case that the charge on the surface of the toner particles is nonuniform, the charge is diffused so that the toner particles are uniformly charged. As a result, excellent developability can be exhibited from initial use to long-term use.

In addition, Japanese Patent Application Laid-Open No. 2015-137208 suggests that environmental characteristics and charging characteristics of toner can be improved by externally adding strontium titanate particles having controlled $SrO/TiO_2$ (molar ratio).

In addition, Japanese Patent Application Laid-Open No. 2010-211245 suggests that strontium titanate particles having a controlled crystal structure or shape are externally added to toner particles, whereby inhibition of an image flow under a high temperature and high humidity environment can be improved.

However, as a result of the study of the present inventors, it was recognized that the strontium titanate particles disclosed in Japanese Patent Application Laid-Open No. 2015-137208 and Japanese Patent Application Laid-Open No. 2010-211245 have a flat surface so that the particles are likely to be present as aggregated particles thereof, and in long-term use, are repeatedly rubbed in a developing device, so that the particles are sometimes likely to be migrated from the toner particles. Therefore, the strontium titanate particles tend to often have reduced transferability at the end of the long term use. Migration refers to a phenomenon in which the strontium titanate particles move from a toner particle to another toner particle or another member. Accordingly, regarding transfer stability of the toner to which strontium titanate particles are externally added, there is room for further study.

SUMMARY OF THE INVENTION

The present disclosure is directed to providing a toner which solves the above disadvantages.

That is, the present disclosure is directed to providing a toner which has good transfer stability even in the case that transfer conditions are changed, and also has a high image density even in the case of long-term use.

The present disclosure relates to a toner including a toner particle; and an external additive, wherein the external additive contains strontium titanate particle, and when in a projected image of the strontium titanate particle photographed using a scanning electron microscope, a standard deviation of a distance from a center of gravity of the projected image to an outline of the projected image is Ds, and a circle-equivalent diameter of the projected image is Da, a value CV calculated from the following Equation (1) is 0.07 or less:

$$CV=Ds/(Da/2) \quad (1).$$

Further features of the present disclosure will become apparent from the following description of exemplary embodiments with reference to the attached drawing.

BRIEF DESCRIPTION OF THE DRAWINGS

FIG. 1*s* an illustration of a method of analyzing adhesion state of strontium titanate particles on toner.

DESCRIPTION OF THE EMBODIMENTS

In the present disclosure, the description "○○ or more and XX or less" or "○○ to XX" representing a numerical range refers to a numerical range including a lower limit and an upper limit which are endpoints, unless otherwise stated.

By externally adding the strontium titanate particles having a hexahedral shape, a contact area between the strontium titanate particles and toner particles, and thus, even in the case that the toner particles are in a state of being charged up by friction charge, the charge is diffused to uniformly charge the toner. As a result, excellent developability and inhibition of fogging can be achieved, from initial use to long-term use.

However, since the strontium titanate particle has a flat surface of a hexahedral shape, a contact area between the strontium titanate particles is increased so that the strontium titanate particles are often present as aggregated particles. Therefore, in long-term use, the strontium titanate particles are repeatedly rubbed in a developing device, so that the particles are likely to be migrated from the toner particles and to have reduced transferability at the end of the long-term use.

Accordingly, in order to suppress the strontium titanate particles from migrating from the toner particles, the present inventors attempted to suppress an aggregation property of the strontium titanate particles. For suppressing the aggregation property, it was considered that a contact area between particles is decreased to make a point contact, whereby it is difficult for aggregation to occur, and even in the case of being agglomerated, the particles are likely to be disintegrated. Therefore, it was found that it is effective to make the shape of the strontium titanate particles close to a spherical shape.

Further, it was found that by making the strontium titanate particles close to a spherical shape, even in the case that transfer conditions are changed (transfer current is changed), stable transferability can be obtained.

The toner according to the present disclosure includes toner particles; and an external additive, wherein the external additive contains strontium titanate particles. Further, the toner according to the present disclosure is characterized in that in a projected image of the strontium titanate particles photographed using a scanning electron microscope, a value CV calculated by the following Equation (1) is 0.07 or less:

$$CV=Ds/(Da/2) \quad (1)$$

wherein Ds represents a standard deviation of a distance from a center of gravity of the projected image to an outline of the projected image, and Da represents a circle-equivalent diameter of the projected image.

The reason why the toner having the above characteristics has good transfer stability even in the case that the transfer conditions are changed is considered by the present inventors, as follows.

The projected image of the strontium titanate particles satisfies Equation (1), thereby representing that the shape is spherical. It is considered that in the case that the shape of the strontium titanate particles is spherical, discharge occurs when transfer current flows to suppress charge of toner, and thus, even in the case that transfer current is changed, transferability is likely to be stabilized. In general, for a discharge phenomenon when voltage is applied to a gap, it is known that when a dielectric material exists in the gap, a potential gradient is higher so that discharge is likely to occur. By making the strontium titanate particles close to a spherical shape, the number of aggregated particles is decreased so that a gap between the toner and a transfer member becomes narrow. When transfer current flows in a state that the gap between the toner and the transfer member is narrowed, it is considered that discharge occurs and charge of the toner is lowered to reduce electrostatic adhesion, so that transferability is stabilized. Transferability is considered as being stabilized due to a small number of aggregated particles, and also further a spherical shape of the particles so that the gap between the toner particles and the strontium titanate particles becomes preferred.

The details of Ds and the measurement method of Ds will be described below, however, Ds can be obtained by process the projected image of the strontium titanate particles with image processing software. A magnification of the strontium titanate particles which are present as primary particles on the surface of the toner particles is set according to the particle diameter (for example, the magnification of particles having a diameter of about 100 nm is 100,000 times), and a distance (Li) from a center of gravity of the projected image to an outline of the projected image is measured at 200 points. Then, a standard deviation of the distance (Li) at 200 points is defined as Ds. Likewise, a circle-equivalent diameter of the projected image (Da) is calculated with image processing software. CV obtained by standardizing the standard deviation (Ds) into a circle-equivalent diameter (Da), represents a parameter extracting only the characteristics of the shape.

The strontium titanate particles disclosed in FIG. 2 of Japanese Patent Application Laid-Open No. 2015-137208 have a shape close to a rounded hexahedral shape without edges, and since a difference between angle portions and the other portions in the projected image of the strontium titanate particle is increased, CV is more than 0.07. In addition, the strontium titanate particles disclosed in FIG. 2 of Japanese Patent Application Laid-Open No. 2010-211245 are amorphous particles, and for the same reason as described above, CV is more than 0.07. In addition, when the shape of the particles is a perfect circle, the distance is equal, and CV is 0. When the value of CV is 0.07 or less, the shape of the strontium titanate particles is close to a perfect circle, and uniform dispersibility of the strontium titanate particles is better, and thus, transfer stability is better. A range of CV is preferably 0.02 or more and 0.07 or less, and more preferably 0.04 or more and 0.06 or less. When the value of CV is more than 0, it is shown that there is fine unevenness on a surface of the strontium titanate particles, and it is preferred that there is fine unevenness on the surface.

CV of the strontium titanate particles is controllable by adjusting an added amount of a hydroxy acid which is added at the time of preparing the particles or a temperature at the time of reaction. As the hydroxy acid, a citric acid, a tartaric acid, or the like may be included.

It is preferred that the circle-equivalent diameter (Da) of the projected image of the strontium titanate particles is 20 nm or more and 200 nm or less, for further stabilization of transfer and inhibition of image defects. Da is more preferably 30 nm or more 130 nm or less. When Da is 200 nm or less, a good image is easily obtained.

The circle-equivalent diameter (Da) of the strontium titanate particles is controllable by adjusting a concentration of initial titanium oxide or a time of adding alkali in the preparation of the strontium titanate particles.

A BET (Brunauer, Emmett and Teller) specific surface area of the strontium titanate particles is preferably 50 $m^2/g$ or more and 100 $m^2/g$ or less, and more preferably 73 $m^2/g$ or more and 90 $m^2/g$ or less. Since the strontium titanate particles of the present application has fine unevenness on the surface thereof, the strontium titanate particles of the present application tend to have a higher BET specific surface area than the conventional strontium titanate particles having the same particle diameter. Within the range of the BET specific surface area, stable transferability is easily obtained, which is thus preferred.

A molar ratio of Sr to Ti of the strontium titanate particles is preferably 1.05 or less, and more preferably 1.00 or less. Since Sr/Ti (molar ratio) is 1.05 or less, and a ratio of Ti which is close to negatively chargeable in terms of chargeability is increased, a charge distribution is likely to be sharp. The molar ratio is preferably 0.90 or less, and more preferably 0.80 or less. Meanwhile, though the lower limit is not particularly limited, the molar ratio is preferably 0.70 or more, and more preferably 0.75 or more. Sr/Ti (molar ratio) is controllable by adjusting a molar ratio of a raw material or preparation conditions of the strontium titanate particles.

It is preferred that when a wettability of the toner with respect to a methanol/water mixed solvent is measured by using a transmissivity of light having a wavelength of 780 nm through the mixed solvent, a methanol concentration in the mixed solvent at the transmissivity of 50% is in the range of 40% by volume to 95% by volume. Besides, 50% by volume to 95% by volume is more preferred, and 60% by volume to 80% by volume is particularly preferred. When the methanol concentration is 50% by volume to 95% by volume, fogging is likely to be improved.

The wettability of the strontium titanate particles in a mixed solvent of methanol/water is controllable by adjusting surface treatment conditions of the strontium titanate particles.

A coverage rate of the surface of toner by strontium titanate particles, which is obtained by an X-ray photoelectron spectroscope (electron spectroscopy for chemical analysis; ESCA) is preferably 2.0% by area or more and 20.0% by area or less, and more preferably 2.0% by area or more and 10.0% by area or less.

When the coverage rate is 2.0% by area or more and 20.0% by area or less, charging of toner is likely to occur from the beginning of repeated use, so that an image density is stabilized. The coverage rate is controllable by adjusting the shape, an added amount, or preparation conditions of the strontium titanate particles, or the properties and state of the toner particles.

An average circularity of the toner particles is preferably 0.935 or more and 0.995 or less. In addition, the average circularity of the toner particles is more preferably 0.960 or more and 0.990 or less.

When the average circularity of the toner particles is within the range, the shape of the toner particles is close to spherical, thereby further improving transfer stability. It is preferred that the shape of the toner particles is close to spherical, since it is difficult for the adhesion state of spherical strontium titanate particles on the toner to be changed. The average circularity of the toner particles is controllable by adjusting preparation conditions.

A glass transition temperature (Tg) of the toner particles is preferably 50° C. or more and 70° C. or less, and more preferably 53° C. or more and 68° C. or less.

When the glass transition temperature (Tg) is within the range, the presence state of the strontium titanate particles on the surface of the toner particles is likely to be stabilized. That is, when the surface of the toner particles has an appropriate hardness, it is difficult for the adhesion state of the strontium titanate particles before and after repeated use to be changed, thereby further stabilizing transferability.

The glass transition temperature (Tg) is controllable by adjusting a composition of a binder resin constituting the toner particles, or the like.

When perovskite type strontium titanate particles are to be prepared, not a hydrothermal treatment using a pressurized container but a normal pressure heating reaction method in which reaction occurs at normal temperature is used.

As a titanium oxide source, a mineral acid deflocculated product of a hydrolysate of a titanium compound is used, and as a strontium source, a water soluble acid compound is used. Further, a method in which reaction is performed by adding an alkaline aqueous solution to a mixed solution thereof at 60° C. or more and then acid treatment is preformed, can be illustrated.

In addition, as a method of controlling the shape of the strontium titanate particles, there is a method of applying mechanical treatment in a dry manner.

Hereinafter, a normal pressure heating method will be described.

As the titanium oxide source, the mineral acid deflocculated product of the hydrolysate of the titanium compound may be used. Preferably, a product deflocculated by adjusting the pH of metatitanic acid having a content of $SO_3$ of 1.0 mass % or less, and more preferably 0.5 mass % or less, which is obtained by a sulfuric acid method, with hydrochloric acid to 0.8 or more and 1.5 or less is used. Thus, the strontium titanate particles having a good particle size distribution can be obtained. Meanwhile, as the strontium source, strontium nitrate, strontium chloride, or the like can be used. As the alkaline aqueous solution, a caustic alkali can be used, but among them, an aqueous sodium hydroxide solution is preferred.

In the preparation method, as a factor affecting the particle diameter of the obtained strontium titanate particles, a mixing ratio of the titanium oxide source and the strontium source, a titanium oxide concentration at the beginning of the reaction, a temperature and adding speed of the alkaline aqueous solution when added, or the like can be included. These factors can be appropriately adjusted for obtaining the strontium titanate particles having desired particle diameter and particle distribution. Further, for preventing production of strontium carbonate in the course of the reaction, it is preferred to prevent incorporation of carbon dioxide gas, such as performing the reaction under a nitrogen gas atmosphere.

A mixing ratio of the titanium oxide source and the strontium source at the time of reaction is preferably 0.90 or more and 1.40 or less, and more preferably 1.05 or more and 1.20 or less, as Sr/Ti (molar ratio).

The strontium source has a high solubility in water, while the titanium oxide source has a low solubility in water, and thus, when Sr/Ti (molar ratio) is less than 0.90, unreacted titanium oxide as well as strontium titanate is likely to remain in the reaction product.

A concentration of the titanium oxide source at the beginning of the reaction is preferably 0.050 mol/L or more and 1.300 mol/L or less, and more preferably 0.080 mol/L or more and 1.200 mol/L or less, as $TiO_2$. By increasing the concentration of the titanium oxide source at the beginning of the reaction, a number average particle diameter of the primary particles of the strontium titanate particles can be decreased.

In order to change the shape of the particles by the normal pressure heating reaction method, a method of adding an additive in a step of forming particles can be used (see Fine particle design, written by Masumi Koishi, p. 216-222). As the additive, a hydroxy acid such as tartaric acid, citric acid, malic acid, or gluconic acid; calcium 2-ketogluconate, sodium gluconate, sucrose, lactose, copper sulfate, zinc sulfate, nickel sulfate, sodium triphosphate, sodium pyrophosphate, sodium monohydrogenphosphate, or the like can be included. Among them, tartaric acid and citric acid are preferred. An added amount of the additive depends on the type of the additive, however, preferably about $1.0\times10^{-4}$ mol/L or more and $1.0\times10^{-2}$ mol/L or less. A more preferred range is about $3.0\times10^{-4}$ mol/L or more and $1.0\times10^{-3}$ mol/L or less.

It is necessary to set a temperature at which the alkaline aqueous solution is added to obtain an effect of the additive to promote crystal growth of the particles. The higher the temperature is, the better the crystallinity of the obtained product is; however, when the temperature is excessively high, it is difficult for the shape of the particles to be spherical. Practically the temperature range is appropriately 30° C. or more and 100° C. or less.

In addition, for an adding speed of the alkaline aqueous solution, the slower the adding speed is, the larger the particle diameter of the obtained strontium titanate particles is, and the faster the adding speed is, the smaller the particle diameter of the obtained strontium titanate particles is. The adding speed of the alkaline aqueous solution is preferably 0.001 equivalents/h or more and 1.2 equivalents/h or less, and more preferably 0.002 equivalents/h or more and 1.1 equivalents/h or less, relative to a fed raw material. The adding speed can be appropriately adjusted depending on the particle diameter to be obtained.

Next, acid treatment is described. When a mixing ratio of the titanium oxide source and the strontium source is more than 1.40, as Sr/Ti (molar ratio), the unreacted strontium source remaining after completion of the reaction is reacted with carbon dioxide gas in the air to produce impurities such as strontium carbonate, and thus, the particle size distribution is likely to be expanded. In addition, when impurities such as strontium carbonate remains on the surface, it is difficult to uniformly coat a surface treatment agent due to the effect of the impurities at the time of surface treatment for imparting hydrophobicity. Accordingly, after the alkaline aqueous solution is added, acid treatment for removing the unreacted strontium source may be performed.

In the acid treatment, pH is adjusted to preferably 2.5 or more and 7.0 or less, and more preferably 4.5 or more and 6.0 or less, based on hydrochloric acid.

As the acid, nitric acid, acetic acid, or the like can be used in the acid treatment, in addition to hydrochloric acid. However, when sulfuric acid is used, strontium sulfate having a low solubility in water is likely to occur.

As a method of shape control, applying mechanical treatment in a dry manner is illustrated, in addition to adding the additive.

For example, a hybridizer (manufactured by NARA MACHINERY CO., LTD.), NOBILTA (manufactured by Hosokawa Micron Corporation), Mechanofusion (manufactured by Hosokawa Micron Corporation), High Flex Gral (manufactured by EARTHTECHNICA Co., Ltd.), or the like can be used.

When the shape of the strontium titanate particles is controlled by mechanical treatment, fine strontium titanate particles sometimes occur. For removing the fine particles, it is preferred to perform acid treatment after mechanical treatment. It is preferred to adjust the pH to 0.1 or more and 5.0 or less using hydrochloric acid, in the acid treatment. As the acid, nitric acid, acetic acid, or the like can be used in the acid treatment, in addition to hydrochloric acid. It is preferred that the mechanical treatment for controlling the shape of the strontium titanate particles is performed before surface treatment of the strontium titanate particles is performed.

The strontium titanate particles may be surface-treated with inorganic oxides such as $SiO_2$ and $Al_2O_3$, and a hydrophobizing agent such as a titanium coupling agent, a silane coupling agent, a silicone oil, and a fatty acid metal salt, for charge adjustment and environmental stability improvement.

As the silane coupling agent, a silane coupling agent to which a functional group such as an amino group and fluorine is introduced can be used.

As the fatty acid metal salt, zinc stearate, sodium stearate, calcium stearate, zinc laurate, aluminum stearate, and magnesium stearate can be included.

As a method of surface treatment, a wet method in which a hydrophobizing agent is dissolved or dispersed in a solvent, strontium titanate particles are added thereto, and the solvent is removed with stirring, thereby performing treatment.

In addition, a dry method in which a hydrophobizing agent and the strontium titanate particles are directly mixed and treatment may be performed with stirring.

A content of the strontium titanate particles is preferably 0.05 parts by mass or more and 5.0 parts by mass or less, and more preferably 0.1 parts by mass or more and 5.0 parts by mass or less, based on 100 parts by mass of the toner particles.

A preparation method of the toner particles is not particularly limited, however, for example, a method of directly preparing the toner particles in an aqueous medium (hereinafter, also referred to as a polymerization method) such as a suspension polymerization method, an interfacial polymerization method, or a dispersion polymerization method can be included. In addition, a pulverization method may be used, or the toner obtained by the pulverization method may be thermally sphericalized to adjust an average circularity. Among them, the suspension polymerization method is preferred. Each of the toner particles prepared by the suspension polymerization method is almost in a spherical shape, and the distribution of a charge amount is relatively uniform, thereby having high transferability.

As the suspension polymerization method, a polymerizable monomer composition containing a polymerizable monomer capable of producing a binder resin, a colorant, and wax is dispersed in an aqueous medium to form particles of the polymerizable monomer composition, and the polymerizable monomer in the particles is polymerized to prepare the toner particles.

The toner particles may have a core-shell structure. The toner particles take the core-shell structure, thereby suppressing a charge defect due to exudation of the core to the surface of the toner particles.

It is preferred that the shell contains at least one selected from the group consisting of a polyester resin, a styrene-acryl copolymer, and a styrene-methacryl copolymer, and it is more preferred that the shell contains a polyester resin.

An amount of resin forming the shell is preferably 0.01 parts by mass or more and 20.0 parts by mass or less, and more preferably 0.5 parts by mass or more and 10.0 parts by mass or less, based on 100 parts by mass of the resin forming the core.

When the polyester resin is used in the shell, the externally added strontium titanate particles are likely to be loosened on the surface of the toner particles, so that the strontium titanate particles are likely to be dispersed. As a result, developability is further improved in long-term use, thereby further suppressing fogging.

It is preferred that a weight average molecular weight of the polyester resin is 5,000 or more and 50,000 or less. When the weight average molecular weight is within the range, the dispersibility of the strontium titanate particles on the surface of the toner particles is more likely to be improved.

As the polymerizable monomer capable of producing the binder resin, a vinyl-based polymerizable monomer can be included. Specifically, the followings can be illustrated:

styrene; a styrene derivative such as α-methyl styrene, β-methyl styrene, o-methyl styrene, m-methyl styrene, p-methyl styrene, and 2,4-dimethyl styrene; an acrylic polymerizable monomer such as methyl acrylate, ethyl acrylate, n-propyl acrylate, iso-propyl acrylate, n-butyl acrylate, iso-butyl acrylate, tert-butyl acrylate, and 2-ethyl hexyl acrylate; a methacrylic polymerizable monomer such as methyl methacrylate, ethyl methacrylate, n-propyl methacrylate, iso-propyl methacrylate, n-butyl methacrylate, iso-butyl methacrylate, and tert-butyl methacrylate; methylene aliphatic monocarboxylic acid esters; or vinyl esters such as vinyl acetate, vinyl propionate, vinyl butyrate, vinyl benzoate, and vinyl formate.

The toner particles may contain a charge control agent. As the charge control agent, those controlling the toner particles to be negatively chargeable, and those controlling the toner particles to be positively chargeable are known, and one or two or more among various types can be used, depending on the type or use of the toner.

As the charge control agent controlling the toner particles to be negatively chargeable, the followings can be illustrated:

an organic metal complex (a monoazo metal complex; acetylacetone metal complex); a metal complex or a metal salt of aromatic hydroxycarboxylic acid or aromatic dicarboxylic acid; aromatic mono- and polycarboxylic acid and a metal salt, anhydride, and esters thereof; and a phenol derivative such as bisphenol. These may be used alone or in combination of two or more.

Among them, a metal complex or a metal salt of aromatic hydroxycarboxylic acid from which stable charge performance is obtained is preferred.

Meanwhile, as the charge control agent controlling the toner particles to be positively chargeable, the followings can be illustrated.

That is, nigrosine and a modified product by a fatty acid metal salt; a quaternary ammonium salt such as tributyl benzyl ammonium-1-hydroxy-4-naphtosulfonate salt and tetrabutylammonium tetrafluoroborate and an analog thereof; an onium salt such as a phosphonium salt and a lake pigment thereof; a triphenylmethane dye and a lake pigment thereof (as a laking agent, phosphorus tungstate, phosphorus molybdate, phosphorus tungsten molybdate, tannic acid, lauric acid, gallic acid, ferricyanic acid, ferrocyanide compound, or the like); and a metal salt of a higher fatty acid can be included. These can be used alone or in combination of two or more.

Among them, a nigrosine-based compound, a quaternary ammonium salt, or the like is preferred.

Since the strontium titanate particles are positively chargeable, when the charge control agent controlling the toner particles to be negatively chargeable, electrostatic adhesion force of the toner particles and the strontium titanate particles is increased, which is more preferred.

It is preferred that a content of the charge control agent is 0.1 parts by mass or more and 10.0 parts by mass or less, based on 100 parts by mass of the polymerizable monomer capable of producing the binder resin or the binder resin.

In addition, it is a preferred embodiment to use a charge control resin. When the toner particles contain the charge control resin, the negative chargeability on the surface of the toner particles is improved. Therefore, the electrostatic adhesion force to the positively chargeable strontium titanate particles is increased, and it is difficult for the strontium titanate particles to migrate from the toner particles, and thus, developability is improved in the long term use so that fogging is easily suppressed.

As the charge control resin, a polymer having a sulfonic acid-based functional group is preferred. A polymer having a sulfonic acid-based functional group is a polymer having a sulfonic acid group, a sulfonate group, or a sulfonic acid ester group. Among them, a polymer having a sulfonic acid group is preferred. Specifically, a homopolymer of a monomer such as styrene sulfonic acid, 2-acrylamide-2-methyl propane sulfonic acid, 2-methacrylamide-2-methyl propane sulfonic acid, vinyl sulfonic acid, and methacryl sulfonic acid, or a copolymer of the monomer and other monomer can be included. In addition, a product obtained by forming the sulfonic acid group of the polymer into a sulfonate group or esterifying the sulfonic acid group can be used. It is preferred that a glass transition temperature (Tg) of the charge control resin is 40° C. or more and 90° C. or less.

It is preferred that a content of the charge control resin is 0.1 parts by mass or more and 10.0 parts by mass or less, based on 100 parts by mass of the polymerizable monomer capable of producing the binder resin or the binder resin. In addition, the charge control resin can improve a charge state of the toner particles, by using the aqueous polymerization initiator in combination.

The toner particles may contain wax. As the wax, the followings can be included:

petroleum wax and derivatives thereof such as paraffin wax, microcrystalline wax, and petrolatum; montan wax and derivatives thereof; hydrocarbon wax and derivatives thereof by a Fischer-Tropsch process; polyolefin wax and derivatives thereof such as polyethylene and polypropylene; natural wax and derivatives thereof such as carnauba wax and candelilla wax; higher aliphatic alcohol; fatty acid such as stearic acid and palmitic acid; acid amide wax; and ester wax.

Further, the derivatives can include oxides and block copolymerized product with a vinyl-based monomer and a graft modified product.

A content of the wax is preferably 2.0 parts by mass or more and 15.0 parts by mass or less, and more preferably 2.0 parts by mass or more and 10.0 parts by mass or less, based on 100 parts by mass of the polymerizable monomer capable of producing a binder resin or the binder resin.

The toner particles may contain a coloring agent.

As a black coloring agent, carbon black and a coloring agent toned to black using yellow, magenta, and cyan coloring agents described below can be included.

As the yellow coloring agent, a condensed azo compound, an isoindolinone compound, an anthraquinone compound, an azo metal complex, a methine compound, and an arylamide compound can be included.

Specifically, C.I. Pigment Yellow 12, 13, 14, 15, 17, 62, 73, 74, 83, 93, 94, 95, 97, 109, 110, 111, 120, 128, 129, 138, 147, 150, 151, 154, 155, 168, 180, 185, and 214 can be included.

As the magenta coloring agent, a condensed azo compound, a diketopyrrolopyrrole compound, an anthraquinone compound, a quinacridone compound, a base dye lake compound, a naphthol compound, a benzimidazolone compound, a thioindigo compound, and perylene compound can be included.

Specifically, C.I. Pigment Red 2, 3, 5, 6, 7, 23, 48:2, 48:3, 48:4, 57:1, 81:1, 122, 146, 166, 169, 177, 184, 185, 202, 206, 220, 221, 238, 254, and 269, C.I. Pigment Violet 19 can be included.

As the cyan coloring agent, a copper phthalocyanine compound and derivatives thereof, an anthraquinone compound, and a base dye lake compound can be included.

Specifically, C.I. Pigment Blue 1, 7, 15, 15:1, 15:2, 15:3, 15:4, 60, 62, and 66 can be included.

The coloring agent can be used alone or in combination, and also in a state of a solid solution.

In order to achieve low consumption of the toner, it is preferred that an added amount of the coloring agent is large. By applying high coloring power to the toner, the toner can produce a predetermined concentration on recording paper with a small toner laid-on level. In addition, it is known that by making a toner laid-on level small, transferability or fixability of the toner is also easily stabilized for a long period. Therefore, it is effective to increase an amount of the coloring agent contained in the toner particles.

Meanwhile, since a high coloring toner has an increased amount of the coloring agent present on the surface of the toner particles, chargeability on the surface of the toner tends to be nonuniform. Generally, the coloring agent tends to represent a positive property, as compared with the binder resin used in the toner particles, and when the high coloring power toner is used, the amount of the coloring agent present on the surface of the toner is increased, whereby unevenness in chargeability on the surface of the toner particles is likely to occur.

Therefore, even in the case of using strong negative silica fine particles, the effect of transfer stability of the high coloring power toner was insufficient. By externally adding strontium titanate, the effect on transfer stability was shown. The reason is that strontium titanate is weak positive, and even in the case that the coloring agent is present in a large amount on the surface of the toner, it is difficult for non-uniformity of chargeability to occur, which is considered as being preferred.

The coloring agent may be selected from the viewpoint of a hue angle, chroma, brightness, light resistance, OHP transparency, and dispersibility in toner particles.

A content of the coloring agent is preferably 1 part by mass or more and 20 parts by mass or less, based on 100 parts by mass of a polymerizable monomer capable of producing the binder resin or the binder resin. 5 parts by mass or more and 20 parts by mass or less is more preferred, from the viewpoint of toner consumption.

It is possible that the toner particles are formed into magnetic toner particles, by containing a magnetic body as the coloring agent. As the magnetic body, iron oxide such as magnetite, hematite, and ferrite; a metal such as iron, cobalt, and nickel, or an alloy of the metal with another metal such as aluminum, copper, magnesium, tin, zinc, beryllium, calcium, manganese, selenium, titanium, tungsten, vanadium, and a mixture thereof can be included.

It is preferred that the magnetic body is surface-modified.

When a magnetic toner is prepared by a polymerization method, it is preferred that the magnetic body is hydrophobized by a surface modifying agent which is a material without inhibition of polymerization. As the surface modifying agent, a silane coupling agent and a titanium coupling agent can be included.

A number average particle diameter of the magnetic body is preferably 0.1 μm or more and 2.0 μm or less, and more preferably 0.1 μm or more and 0.5 μm or less.

A content of the magnetic body is preferably 20 parts by mass or more and 200 parts by mass or less, and more preferably 40 parts by mass or more and 150 parts by mass or less, based on 100 parts by mass of the polymerizable monomer capable of producing the binder resin or the binder resin.

Meanwhile, an example of the preparation method of the toner particles by a pulverization method is described below.

In a mixing process of a raw material, predetermined amounts of the binder resin, the coloring agent, the wax, and the like, as the materials constituting the toner particles are weighed, combined, and mixed.

As an example of the mixing device, a double cone mixer, a V type mixer, a drum type mixer, a super mixer, an FM mixer, a nauta mixer, and a Mechano Hybrid (manufactured by NIPPON COKE & ENGINEERING CO., LTD.), or the like can be included.

Next, the mixed materials are melt-kneaded to disperse the coloring agent, wax, and the like in the binder resin. In the melt-kneading process, a batchwise kneader such as a pressure kneader and a Banbury mixer, or a continuous kneader can be used. From the advantage of continuous production possibility, a single screw extruder or a twin screw extruder is the mainstream. For example, a KTK type twin screw extruder (manufactured by Kobe Steel, Ltd.), a TEM type twin screw extruder (manufactured by TOSHIBA MACHINE CO., LTD.), a PCM kneader (manufactured by Ikegai Corp.), a twin screw extruder (manufactured by KCK Engineering Co., Ltd.), a co-kneader (manufactured by Buss Co., Ltd.), Kneadex (manufactured by NIPPON COKE & ENGINEERING CO., LTD.), or the like can be included. In addition, the resin composition obtained by melt-kneading can be rolled by two-roll or the like, and cooled by water and the like in a cooling process.

Subsequently, the obtained cooled product was pulverized to have a desired particle diameter by a pulverizing process.

In the pulverizing process, coarse pulverization is performed with a pulverizer such as for example, a crusher, a hammer mill, and a feather mill. Thereafter, fine pulverization may be performed with Kryptron System (manufactured by Kawasaki Heavy Industries, Ltd.), Super Rotor (manufactured by Nisshin Engineering Inc.), Turbor mill (manufactured by FREUND-TURBO CORPORATION), or a fine pulverizer in an air jet manner.

Thereafter, if necessary, classifying is performed using a classifier or a sieving machine such as Elbow-Jet in a inertial classification manner (manufactured by Nittetsu Mining CO., Ltd.), Turboplex in a centrifugal classification manner (manufactured by Hosokawa Micron Corporation), TSP Separator (manufactured by Hosokawa Micron Corporation), and FACULTY (manufactured by Hosokawa Micron Corporation) to obtain the toner particles.

In addition, the toner particles can be sphericized. For example, sphericalization may be performed using Hybridization System (manufactured by NARA MACHINERY CO., LTD.), Mechanofusion System (manufactured by Hosokawa Micron Corporation), FACULTY (manufactured by Hosokawa Micron Corporation), and Meteorainbow MR Type (manufactured by Nippon Pneumatic Mfg. Co., Ltd.) after pulverization.

The toner can be obtained by mixing the toner particles with strontium titanate particles, or if necessary another external additive. As a mixer for mixing the external additive, FM mixer (manufactured by NIPPON COKE & ENGINEERING CO., LTD.), Super Mixer (manufactured by KAWATA MFG. CO., LTD.), NOBILTA (manufactured by Hosokawa Micron Corporation), and a hybridizer (manufactured by NARA MACHINERY CO., LTD.) can be included.

In addition, after mixing the external additive, coarse particles can be sieved. As a sieve device used therefor, the followings can be included:

ULTRA SONIC (manufactured by KOEISANGYO Co., Ltd.); Resonasieve, Gyro-Sifter (manufactured by TOKUJU Co., LTD.); Vibrasonic System (manufactured by DALTON CORPORATION); Sony clean (manufactured by SINTOKOGIO, LTD.); TURBO-SCREENER (manufactured by FREUND-TURBO CORPORATION); or MICRO-SHIFTER (manufactured by MAKINO Mfg. Co., Ltd.).

The toner may include other external additives in addition to the strontium titanate particles. Particularly, for improving flowability or chargeability of the toner, a flowability improver may be added.

As the flowability improver, the followings can be used:

fluorine-based resin powder such as vinylidene fluoride fine powder and polytetrafluoroethylene fine powder; silica fine particles such as wet preparation process silica or dry preparation process silica, titanium oxide fine particles, alumina fine particles; hydrophobized fine particles obtained by surface-treating the fine particles with a hydrophobizing agent such as a silane compound, a titanium coupling agent, or silicone oil; oxides such as zinc oxide and tin oxide; multiple oxides such as barium titanate, calcium titanate, strontium zirconate, and calcium zirconate; a carbonate compound such as calcium carbonate and magnesium carbonate; and the like.

Among them, dry process silica fine particles which are fine particles produced by vapor phase oxidation of a silicon halogen compound and also called, dry process silica or fumed silica are preferred. A dry preparation process uses a pyrolysis oxidation reaction in oxyhydrogen flame of silicon tetrachloride gas, and is based on the following reaction formula:

$$SiCl_4+2H_2+O_2 \rightarrow SiO_2+4HCl$$

In the preparation process, other metal halogen compound such as aluminum chloride or titanium chloride is used together with the silicon halogen compound, whereby composite fine particles of silica and other metal oxide can be obtained, and the silica fine particles also include the composite fine particles.

When the number average particle diameter of the primary particles of the flowability improver is 5 nm or more and 30 nm or less, the flowability improver can have high chargeability and flowability, which is preferred.

In addition, as the silica fine particles, hydrophobized silica fine particles which is surface-treated with the hydrophobizing agent is more preferred.

It is preferred that the flowability improver has a specific surface area by nitrogen adsorption of 30 $m^2/g$ or more and 300 $m^2/g$ or less, as measured by a BET method.

A content of the flowability improver is 0.01 parts by mass or more and 3.0 parts by mass or less, as the total amount of the flowability improver, based on 100 parts by mass of the toner particles.

A measurement method of various physical properties according to the toner and other materials is described as follows.

The physical properties of the strontium titanate are measured using the toner as a sample.

When the physical properties of the strontium titanate particles or the toner particles are measured from the toner to which the strontium titanate particles are externally added, measurement may be performed by separating the strontium titanate particles or other external additives from the toner, as follows.

The toner is dispersed by ultrasonic waves in methanol to remove the strontium titanate particles or other external additives and allowed to stand for 24 hours. The toner particles are separated from the strontium titanate particles or other external additives by centrifugation, collected, and sufficiently dried, whereby the toner particles can be isolated from the strontium titanate particles.

<Measurement of a Standard Deviation (Ds) from the Center of Gravity of the Projected Image to the Outline of the Projected Image of Strontium Titanate Particles and a Circle-Equivalent Diameter (Da) of the Projected Image of Particles>

Measurement of standard deviation (Ds) of the distance (Li) from the center of gravity of the projected image to the outline of the projected image of the strontium titanate particle and circle-equivalent diameter (Da) of the projected image is performed by observing the toner to which the strontium titanate particles are externally added, and performing calculation as follows.

The surface of the toner is observed using Hitachi Ultra-high Resolution emission scanning electron microscope S-4800 (manufactured by Hitachi High-Technologies Corporation). As an observation condition, an observation magnification is appropriately set at 100,000 times to 200,000 times depending on the size of the strontium titanate particles. In addition, in order to perform image processing of inorganic fine particles, acceleration voltage at the time of observation is set a little higher (for example, 5 kV) and observation is performed with a reflection electron image, thereby expressing the strontium titanate particles with high luminance and the toner particles with low luminance, which is thus preferred.

Image processing software, "Image-Pro Plus 5.1 J" (manufactured by Media Cybernetics) was used to acquire a binarized image. An outline is extracted from the binarized image, and a coordinate is acquired. The coordinate of the outline is set as (Xi, Yi), and 200 points are obtained as the coordinate of the outline. In addition, a center of gravity coordinate ($X_G$, $Y_G$) and an area (S) are obtained from an outline image obtained from the binarized image. A distance ($L_i$) from the center of gravity to each outline point (Xi, Yi) is calculated by the following Equation (2):

$$Li=\sqrt{(Xi-XG)^2+(Yi-YG)^2} \quad (2).$$

A stand deviation (ds) of a distance from the center of gravity of the projected image to the outline of the projected image of the strontium titanate particles is calculated from the standard deviation of $L_i$.

In addition, the circle-equivalent diameter (da) of the projected image is calculated from the area (S) by the following Equation (3):

$$da=2\times(S/\pi)^{1/2} \quad (3).$$

The observation and measurement as described above were performed for 100 strontium titanate particles to calculate the circle-equivalent diameter (ds) and the standard deviation (da) of each particle. In the present disclosure, the average values of ds and da of each particle were calculated, respectively, which were set as the circle-equivalent diameter (Ds) and the standard deviation (Da) of the strontium titanate particles, and CV was calculated from the following Equation (1):

$$CV=Ds/(Da/2) \quad (1).$$

Whether the external additive is the strontium titanate is confirmed from the measurement of STEM-EDS. Measurement conditions are as follows:

JEM2800 type transmission electron microscope: acceleration voltage 200 kV

EDS detector: JED-2300 T (JEOL Ltd., element area 100 $mm^2$)

EDS analyzer: Noran System7 (Thermo Fisher Scientific)

X-ray storage rate: 10,000 to 15,000 cps

Dead time: an electron dose is adjusted to 20 to 30%, and EDS analysis (accumulation number of 100 times or a measurement time of 5 minutes) is performed.

<Measurement of Coverage Rate by Strontium Titanate Particles on the Surface of the Toner>

A coverage rate by the strontium titanate particles on the surface of the toner is obtained by measuring the toner under the following conditions, and performing calculation from the following Equation (4).

The following device is used under the following condition to perform element analysis on the surface of the toner.

Measurement device: X-ray photoelectron spectroscope: Quantum2000 (manufactured by ULVAC-PHI, INCORPORATED)

X-ray source: monochrome Al Kα

X-ray setting: 100 μmφ (25 W (15 KV))
Photoelectron take-off angle: 45°
Neutralization condition: using a neutralization gun and an ion gun in combination
Analysis region: 300×200 μm
Pass Energy: 58.70 eV
Step size: 0.125 eV
Analysis software: Maltipak (ULVAC-PHI, INCORPORATED)

Here, a Ti atom was used for quantification of the strontium titanate particles. The quantitative value is calculated using the peak of Ti 2p (B. E. 452 to 468 eV). The obtained quantitative value of the Ti element is set as Z1.

Then, the elemental analysis of a single strontium titanate particle is performed in the same manner as in the elemental analysis of the toner surface as described above, and the thus obtained quantitative value of the Ti element is set as Z2. The coverage rate (X) by the strontium titanate particles on the surface of the toner is calculated from the following Equation (4), using Z1 and Z2.

$$\text{Coverage rate (\%)}=Z1/Z2\times 100 \quad (4).$$

Further, in order to improve the accuracy of the measurement, it is preferred that the measurement of Z1 and Z2 is performed twice or more. In determining the quantitative value Z2, when the strontium titanate particles used in external addition is obtainable, the measurement may be performed using the particles.

<Measurement of Sr/Ti (Molar Ratio) of Strontium Titanate Particles>

The contents of Sr and Ti in the strontium titanate particles are measured using a wavelength dispersion type fluorescent X-ray analyzer (Axios advanced, manufactured by PANalytical).

1 g of a sample was weighed on an exclusive cup for measuring powder recommended by PANalytical to which an exclusive film is attached to measure elements from Na to U in the strontium titanate particles by an FP method under an atmospheric pressure He atmosphere.

Here, it is assumed that all detected elements are oxides, and the total mass thereof is set as 100%, thereby obtaining contents of SrO and $TiO_2$ (% by mass) relative to the total mass as a conversion value of the oxides with software, SpectraEvaluation (version 5.0 L). Thereafter, Sr/Ti (mass ratio) excluding oxygen is calculated from the quantification, which is then converted into Sr/Ti (molar ratio), from the atomic weight of each element.

Then, as the sample, strontium titanate particles isolated from the toner is used. In addition, in the following Examples, measurement is performed also in the prepared strontium titanate particles.

<Measurement of Degree of Wettability of Strontium Titanate Particles>

The degree of wettability of the strontium titanate particles is measured by powder wettability tester, "WET-100 P" (manufactured by RHESCA CO., LTD.).

To a cylindrical glass container having a diameter of 5 cm and a thickness of 1.75 mm, a spindle type rotor having a fluorine resin coated length of 25 mm and a maximum body diameter of 8 mm is added.

To the cylindrical glass container, 70 mL of a hydrous methanol liquid composed of 50% by volume of methanol and 50% by volume of water is added. Thereafter, 0.5 g of the strontium titanate particles isolated from the toner is added thereto and set in the powder wettability tester.

Stirring is performed at a rate of 3.3 $s^{-1}$ using a magnetic stirrer, while methanol is added to the liquid at a rate of 0.8 mL/min, through the powder wettability tester.

Transmittance is measured with light at a wavelength of 780 nm, and a value expressed by volume percentage of methanol (=(volume of methanol/volume of mixture)×100) when the transmittance reaches 50% is set as the degree of wettability. Depending on the degree of wettability of the sample, the initial volume ratio of methanol and water is appropriately adjusted. In addition, in the following Examples, the measurement is performed also in the prepared strontium titanate particles.

<Measurement of BET Specific Surface Area of Strontium Titanate Particles>

The BET specific surface area of the strontium titanate particles is measured in accordance with JIS Z8830 (2001). The specific measurement method is as follows.

As a measurement device, "automatic specific surface area·micropore distribution measurement device TriStar3000 (manufactured by SHIMADZU CORPORATION)" which adopts a gas adsorption method by a constant volume method as a measurement manner is used. Setting of the measurement conditions and analysis of measured data are performed using exclusive software "TriStar3000 Version4.00" which is attached to the device. In addition, a vacuum pump, a nitrogen gas pipe, and a helium gas pipe are connected to the device. Nitrogen gas is used as adsorption gas to calculate a value by a BET multipoint method, and the value is the BET specific surface area in the present disclosure.

Specifically, the BET specific surface area is calculated as follows.

First, nitrogen gas is adsorbed in a sample (strontium titanate particles), and equilibrium pressure P (Pa) in a sample cell and nitrogen adsorption amount of the sample Va ($mol\cdot g^{-1}$) at that time are measured. Then, an adsorption isotherm having a horizontal axis which is a relative pressure (Pr) obtained by dividing the equilibrium pressure, P (Pa) in the sample by saturated vapor pressure of nitrogen, Po (Pa) and a vertical axis which is the nitrogen adsorption amount, Va ($mol\cdot g^{-1}$) is obtained. Then, a monomolecular layer adsorption amount, Vm ($mol\cdot g^{-1}$) which is an adsorption mount required for forming a monomolecular layer on the surface of the sample is obtained by applying the following BET equation:

$$Pr/Va(1-Pr)=1/(V\times C)+(C-1)\times Pr/(Vm\times C)$$

wherein C is a BET parameter, which is a variable varied depending on the type of a measurement sample, the type of adsorption gas, or an adsorption temperature.

The BET equation is interpreted as a straight line with a slope of (C−1)/(Vm×C) and an intercept of 1/(Vm×C), when x-axis is Pr and y-axis is Pr/Va(1−Pr) (this straight line is referred to as a BET plot).

$$\text{Slope of straight line}=(C-1)/(Vm\times C)$$

$$\text{Intercept of straight line}=1/(Vm\times C)$$

A found value of Pr and a found value of Pr/Va(1−Pr) are plotted on the graph, a straight line is drawn by a least square method, and the values of the slope and the intercept of the straight line are calculated. These values are used to solve simultaneous equations of the slope and the intercept, thereby calculating Vm and C.

In addition, the BET specific surface area (S) ($m^2\cdot g^{-1}$) of the sample is calculated, based on the following equation, from Vm and the molecular occupied cross-sectional area (0.162 $nm^2$) of a nitrogen molecule as calculated above:

$$S = Vm \times N \times 0.162 \times 10^{-18}$$

wherein N is the Avogadro's number ($mol^{-1}$).

Next, a calculation method of Vm is described in detail. The calculation method of Vm using the device is in accordance with "TriStar3000 manual V4.0" which is attached to the device, but specifically, the measurement follows the following order.

A weight of exclusive sample cell made of glass (a stem diameter of ⅜ inch and a volume of about 5 ml) which has been sufficiently washed and dried is precisely weighed. Then, the sample is added to the sample cell using a funnel. An amount of the sample is appropriately adjusted depending on the specific gravity of the particle diameter of the sample, but in the case of the strontium titanate particles, about 0.5 g is added thereto.

The sample cell to which the sample is placed is set in "a pretreatment device VacPrep 061 (manufactured by SHIMADZU CORPORATION)" to which a vacuum pump and a nitrogen gas pipe are connected, and vacuum degassing is continued at 23° C. for about 10 hours. Then, at the time of vacuum degassing, degassing is slowly performed while adjusting the valve, so that the sample is not sucked into the vacuum pump. Pressure in the cell is slowly lowered with degassing, and finally becomes about 0.4 Pa (about 3 millitorr). After vacuum degassing is finished, nitrogen gas is slowly injected to return the inside of the sample cell to atmospheric pressure, and the sample cell is detached from the pretreatment device. The mass of the sample cell is precisely weighed, and the accurate mass of the strontium titanate particles is calculated from the difference from the weight. Then, at this time, the sample cell is covered with a rubber stopper during weighing, so that the sample in the sample cell is not contaminated with moisture in the atmosphere.

Subsequently, free space in the sample cell including a connector is measured. The free space is calculated by measuring the volume of the sample cell using helium gas at 23° C., continuously measuring the volume of the sample cell after cooling the sample cell with liquid nitrogen using helium gas likewise, and converting a difference between these volumes. In addition, the saturation vapor pressure of nitrogen, Po (Pa) is separately automatically measured, using a Po tube embedded in the device.

Next, vacuum degassing in the sample cell is performed, and the sample cell is cooled with liquid nitrogen while vacuum degassing is continued. Thereafter, nitrogen gas is introduced to the sample cell stepwisely to adsorb nitrogen molecules on the sample. At this time, equilibrium pressure P (Pa) is often measured to obtain the adsorption isotherm, and thus, this adsorption isotherm is converted to a BET plot. Then, the point of the relative pressure (Pr) collecting the data is set as the sum of 6 points, 0.05, 0.10, 0.15, 0.20, 0.25, and 0.30. For the obtained measurement data, a straight line is drawn by the least square method, and Vm is calculated from the slope and the intercept of the straight line. In addition, the Vm value is used to calculate the BET specific surface area of the strontium titanate particles as described above.

<Measurement of Average Circularity of Toner Particles>

The average circularity of the toner particles is measured as a measurement and analysis condition at the time of calibration work, by a flow type particle image analyzer, "FPIA-3000" (manufactured by Sysmex Corporation).

The specific measurement method is as follows.

First, about 20 mL of ion exchange water from which impure solids and the like are removed is added to a container made of glass. As a dispersing agent, about 0.2 mL of a diluent solution obtained by diluting "Contaminon N" (a 10% by mass aqueous solution of a neutral detergent at pH 7 for washing a precision measurement instrument, composed of a nonionic surfactant, an anionic surfactant, and an organic builder, manufactured by Wako Pure Chemical Industries, Ltd.) with ion exchange water to about three times the original mass is added thereto. In addition, about 0.02 g of the measurement sample is added, and dispersion treatment is performed using an ultrasonic disperser for 2 minutes, thereby producing a dispersion for measurement. At that time, the temperature of the dispersion is appropriately cooled to 10° C. to 40° C. As the ultrasonic disperser, a tabletop type ultrasonic cleaner disperser having an oscillation frequency of 50 kHz and electrical output of 150 W (for example, "VS-150" (manufactured by VELVO-CLEAR)) is used, a predetermined amount of ion exchange water is added to a water tank, and about 2 mL of Contaminon N is added to the water tank.

In the measurement, as an objective lens, a flow type particle image analyzer equipped with "LUCPLFLN" (magnification of 20 times, numerical aperture of 0.40) is used, and in a sheath liquid, a particle sheath "PSE-900 A" (manufactured by Sysmex Corporation) is used. A dispersion prepared by the above order is introduced to the flow type particle image analyzer, and 2000 toner particles in a total count mode are measured in an HPF measurement mode.

Then, a binary threshold value at the time of particle analysis is set as 85%, and the analytical particle diameter is limited to a circle-equivalent diameter equal to or more than 1.977 μm and less than 39.54 μm, thereby obtaining the average circularity of the toner particles.

At the time of measurement, standard latex particles (for example, "RESEARCH AND TEST PARTICLES Latex Microsphere Suspensions 5100 A" manufactured by Duke Scientific diluted with ion exchange water) are used to perform auto focus adjustment. Thereafter, it is preferred to perform focus adjustment every 2 hours from measurement initiation.

Further, in the Examples, a flow type particle image analyzer subjected to calibration work by Sysmex Corporation to have a calibration certificate issued by Sysmex Corporation was used. Measurement is performed under the measurement and analysis conditions when the calibration certificate is issued, except that the analytical particle diameter is limited to the circle-equivalent diameter equal to or more than 1.977 μm and less than 39.54 μm.

<Measurement of Glass Transition Temperature (Tg) of Toner Particles>

The glass transition temperature of the toner particles is measured in accordance with ASTM D3418-82, using a differential scanning calorimeter, "Q1000" (manufactured by TA Instruments).

The temperature correction of the device detector uses a melting point of indium and zinc, and correction of heat quantity uses heat of fusion of indium.

Specifically, about 5 mg of a sample is precisely weighed, which is added to a pan made of aluminum, and using an empty pan made of aluminum as a reference, measurement is performed at a heating rate of 10° C./min, in a measurement temperature range of 30° C. or more and 200° C. or less.

Then, in the measurement, heating once to 200° C. is performed, continuously cooling to 30° C. is performed at a cooling rate of 10° C./min, and then again, heating is performed at a heating rate of 10° C./min.

In a DSC curve obtained from the second heating process, an intersection of a line of a midpoint of a baseline before and after specific heat change occurs and the DSC curve is set as the glass transition temperature (Tg).

According to the present disclosure, the toner having good transfer stability even in the case that the transfer conditions are changed, and having higher image density even in the case of being used for a longer period of time, can be provided.

EXAMPLES

Hereinafter, the present disclosure will be described in detail, referring to the Examples and the Comparative Examples, however, the present disclosure is not restricted in any way. Further, all parts and percentage in the Examples and the Comparative Examples are by mass, unless otherwise stated.

The strontium titanate particles were prepared as follows. The physical properties of the strontium titanate particles 1 to 14 are shown in Table 1.

Preparation Example of Strontium Titanate Particles 1

Metatitanic acid obtained by a sulfuric acid method was subjected to di-iron bleaching, 10 mol/L of an aqueous sodium hydroxide solution was added thereto to adjust the pH to 9.0 to perform desulfurization treatment, and thereafter, 6 mol/L of hydrochloric acid was used for neutralization to adjust the pH to 5.8, and filtration with washing was performed. Water was added to a cake after washing to produce $TiO_2$, which is made into 2.25 mol/L of slurry, and then 6 mol/L of hydrochloric acid was added to adjust the pH to 1.3, thereby performing peptization treatment.

To peptized metatitanic acid slurry which was subjected to desulfurization and peptization, an aqueous strontium chloride solution was added by an amount of 1.15 as a $SrO/TiO_2$ molar ratio. Next, 0.0016 mol of citric acid was added to adjust a $TiO_2$ concentration to 0.313 mol/L. Next, a mixed solution of metatitanic acid and strontium chloride was heated to 90° C. with stirring and mixing, and then 296 ml of 5 mol/L of an aqueous sodium hydroxide solution was added for 7 hours, and thereafter, stirring was continued at 95° C. for 1 hour, and the reaction was completed. The reaction slurry was cooled to 50° C., and 6 mol/L of hydrochloric acid was added up to pH 5.0 and stirring was continued for 1 hour. A supernatant was removed, and 50 L of pure water was added and washing by decantation was performed.

The slurry including the precipitation was adjusted to 50° C., 6 mol/L of hydrochloric acid was added to adjust the pH to 2.5, 4.0% by mass of isobutyltrimethoxysilane was added with respect to solids, and stirring was maintained for 14 hours. 5 mol/L of an aqueous sodium hydroxide solution was added to adjust the pH to 8.0, stirring was continued for 1 hour, and then filtration and washing were performed to obtain a cake, which was dried for 8 hours under an atmosphere at 120° C., thereby obtaining strontium titanate particles 1.

Preparation Example of Strontium Titanate Particles 2

Desulfurization and peptization treatment of metatitanic acid was performed in the same manner as in the Preparation Example of strontium titanate particles 1.

To peptized metatitanic acid slurry which was subjected to desulfurization and peptization, an aqueous strontium chloride solution was added by an amount of 1.15 as a $SrO/TiO_2$ molar ratio. Next, 0.0016 mol of citric acid was added to adjust a $TiO_2$ concentration to 0.245 mol/L. Next, a mixed solution of metatitanic acid and strontium chloride was heated to 90° C. with stirring and mixing, 280 ml of 5 mol/L of an aqueous sodium hydroxide solution was added for 8 hours, and thereafter, stirring was continued at 95° C. for 1 hour, and the reaction was completed. The reaction slurry was cooled to 50° C., and 6 mol/L of hydrochloric acid was added up to pH 5.0 and stirring was continued for 1 hour. A supernatant was removed and 50 L of pure water was added to perform washing by decantation.

The slurry including the precipitation was adjusted to 50° C., 6 mol/L of hydrochloric acid was added to adjust the pH to 2.5, 3.0% by mass of isobutyltrimethoxysilane was added with respect to solids, and stirring was maintained for 14 hours. 5 mol/L of an aqueous sodium hydroxide solution was added to adjust the pH to 8.0, stirring was continued for 1 hour, and then filtration and washing were performed to obtain a cake, which was dried for 8 hours under an atmosphere at 120° C., thereby obtaining strontium titanate particles 2.

Preparation Example of Strontium Titanate Particles 3

Desulfurization and peptization treatment of metatitanic acid was performed in the same manner as in the Preparation Example of strontium titanate particles 1.

To peptized metatitanic acid slurry which was subjected to desulfurization and peptization, an aqueous strontium chloride solution was added by an amount of 1.15 as a $SrO/TiO_2$ molar ratio. Next, 0.010 mol of citric acid was added to adjust a $TiO_2$ concentration to 0.256 mol/L. Next, a mixed solution of metatitanic acid and strontium chloride was heated to 85° C. with stirring and mixing, 280 ml of 5 mol/L of an aqueous sodium hydroxide solution was added for 8 hours, and thereafter, stirring was continued at 95° C. for 1 hour, and the reaction was completed. The reaction slurry was cooled to 50° C., 6 mol/L of hydrochloric acid was added up to pH 5.0, and stirring was continued for 1 hour. The supernatant was removed, and 50 L of pure water was added to perform washing by decantation.

The slurry including the precipitation was adjusted to 50° C., 6 mol/L of hydrochloric acid was added to adjust the pH to 2.5, 3.0% by mass of isobutyltrimethoxysilane was added with respect to solids, and stirring was continuously maintained for 14 hours. 5 mol/L of an aqueous sodium hydroxide solution was added to adjust the pH to 8.0, stirring was continued for 1 hour, filtration and washing were performed to obtain a cake, which was dried for 8 hours under an atmosphere at 120° C., thereby obtaining strontium titanate particles 3.

Preparation Example of Strontium Titanate Particles 4

Desulfurization and peptization treatment of metatitanic acid was performed in the same manner as in the Preparation Example of strontium titanate particles 1.

To peptized metatitanic acid slurry which was subjected to desulfurization and peptization, an aqueous strontium chloride solution was added by an amount of 1.15 as a $SrO/TiO_2$ molar ratio. Next, 0.0003 mol of citric acid was added to adjust a $TiO_2$ concentration to 0.263 mol/L. Next, a mixed solution of metatitanic acid and strontium chloride was heated to 95° C. with stirring and mixing, 280 ml of 5 mol/L of an aqueous sodium hydroxide solution was added for 8 hours, and thereafter, stirring was continued at 95° C. for 1 hour, and the reaction was completed. The reaction slurry was cooled to 50° C., 6 mol/L of hydrochloric acid was added up to pH 5.0, and stirring was continued for 1 hour. The supernatant was removed, and 50 L of pure water was added to perform washing by decantation.

The slurry including the precipitation was adjusted to 50° C., 6 mol/L of hydrochloric acid was added to pH 2.5, 3.0% by mass of isobutyltrimethoxysilane was added with respect to solids, and stirring was continuously maintained for 14 hours. 5 mol/L of an aqueous sodium hydroxide solution was added to adjust the pH to 8.0, stirring was continued for 1 hour, and filtration and washing were performed to obtain a cake, which was dried for 8 hours under an atmosphere at 120° C., thereby obtaining strontium titanate particles 4.

Preparation Example of Strontium Titanate Particles 5

Desulfurization and peptization treatment of metatitanic acid was performed in the same manner as in the Preparation Example of strontium titanate particles 1.

To peptized metatitanic acid slurry which was subjected to desulfurization and peptization, an aqueous strontium chloride solution was added by an amount of 1.15 as a $SrO/TiO_2$ molar ratio. Next, 0.0016 mol of citric acid was added to adjust a $TiO_2$ concentration to 0.412 mol/L. Next, a mixed solution of metatitanic acid and strontium chloride was heated to 90° C. with stirring and mixing, then 370 ml of 7.5 mol/L of an aqueous sodium hydroxide solution was added for 3 hours, and thereafter, stirring was continued at 95° C. for 1 hour, and the reaction was completed. The reaction slurry was cooled to 50° C., 6 mol/L of hydrochloric acid was added up to pH 5.0, and stirring was continued for 1 hour. The supernatant was removed, and 50 L of pure water was added to perform washing by decantation.

The slurry including the precipitation was adjusted to 50° C., 6 mol/L of hydrochloric acid was added to adjust the pH to 2.5, 7.0% by mass of isobutyltrimethoxysilane was added with respect to solids, and stirring was continuously maintained for 14 hours. 5 mol/L of an aqueous sodium hydroxide solution was added to adjust the pH to 8.0, stirring was continued for 1 hour, and filtration and washing were performed to obtain a cake, which was dried for 8 hours under an atmosphere at 120° C., thereby obtaining strontium titanate particles 5.

Preparation Example of Strontium Titanate Particles 6

Desulfurization and peptization treatment of metatitanic acid was performed in the same manner as in the Preparation Example of strontium titanate particles 1.

To peptized metatitanic acid slurry which was subjected to desulfurization and peptization, an aqueous strontium chloride solution was added by an amount of 1.15 as a $SrO/TiO_2$ molar ratio. Next, 0.010 mol of citric acid was added to adjust a $TiO_2$ concentration to 0.530 mol/L. Next, a mixed solution of metatitanic acid and strontium chloride was heated to 90° C. with stirring and mixing, 444 ml of 10 mol/L of an aqueous sodium hydroxide solution was added for 1 hour, and thereafter, stirring was continued at 95° C. for 1 hour, and the reaction was completed. The reaction slurry was cooled to 50° C., 6 mol/L of hydrochloric acid was added up to pH 5.0, and stirring was continued for 1 hour. The supernatant was removed, and 50 L of pure water was added to perform washing by decantation.

The slurry including the precipitation was adjusted to 50° C., 6 mol/L of hydrochloric acid was added to adjust the pH to 2.5, 10.0% by mass of isobutyltrimethoxysilane was added with respect to solids, and stirring was continuously maintained for 14 hours. 5 mol/L of an aqueous sodium hydroxide solution was added to adjust the pH to 8.0, stirring was continued for 1 hour, and filtration and washing was performed to obtain a cake, which was dried for 8 hours under an atmosphere at 120° C., thereby obtaining strontium titanate particles 6.

Preparation Example of Strontium Titanate Particles 7

Desulfurization and peptization treatment of metatitanic acid was performed in the same manner as in the Preparation Example of strontium titanate particles 1.

To peptized metatitanic acid slurry which was subjected to desulfurization and peptization, an aqueous strontium chloride solution was added by an amount of 1.15 as a $SrO/TiO_2$ molar ratio. Next, 0.0008 mol of citric acid was added to adjust a $TiO_2$ concentration to 0.530 mol/L. Next, a mixed solution of metatitanic acid and strontium chloride was heated to 95° C. with stirring and mixing, then 444 ml of 10 mol/L of an aqueous sodium hydroxide solution was added for 1 hour, and thereafter, stirring was continued at 95° C. for 1 hour, and the reaction was completed. The reaction slurry was cooled to 50° C., 6 mol/L of hydrochloric acid was added up to pH 5.0, and stirring was continued for 1 hour. The supernatant was removed, and 50 L of pure water was added to perform washing by decantation.

The slurry including the precipitation was adjusted to 70° C., 10.0% by mass of 50 cSt silicone oil was added with respect to solids, and stirring was continuously maintained for 1 hour. 5 mol/L aqueous of a sodium hydroxide solution was added to adjust the pH to 6.5, stirring was continued for 1 hour, and filtration and washing was performed to obtain a cake, which was dried for 8 hours under an atmosphere at 120° C., thereby obtaining strontium titanate particles 7.

Preparation Example of Strontium Titanate Particles 8

Desulfurization and peptization treatment of metatitanic acid was performed in the same manner as in the Preparation Example of strontium titanate particles 1.

To peptized metatitanic acid slurry which was subjected to desulfurization and peptization, an aqueous strontium chloride solution was added by an amount of 1.15 as a $SrO/TiO_2$ molar ratio. Next, 0.0003 mol of tartaric acid was added to adjust a $TiO_2$ concentration to 0.530 mol/L. Next, a mixed solution of metatitanic acid and strontium chloride was heated to 95° C. with stirring and mixing, then 444 ml of 10 mol/L of an aqueous sodium hydroxide solution was added for 1 hour, and thereafter, stirring was continued at 95° C. for 1 hour, and the reaction was completed. The reaction slurry was cooled to 50° C., 6 mol/L of hydrochloric acid was added up to pH 5.0, and stirring was continued for 1 hour. The supernatant was removed, and 50 L of pure water was added to perform washing by decantation.

The slurry including the precipitation was adjust to 70° C., 5 mol/L of an aqueous sodium hydroxide solution was added to adjust the pH to 6.5, stirring was continued for 1 hour, and filtration and washing was performed to obtain a cake, which was dried for 8 hours under an atmosphere at 120° C., thereby obtaining strontium titanate particles 8.

Preparation Example of Strontium Titanate Particles 9

Desulfurization and peptization treatment of metatitanic acid was performed in the same manner as in the Preparation Example of strontium titanate particles 1.

To peptized metatitanic acid slurry which was subjected to desulfurization and peptization, an aqueous strontium chloride solution was added by an amount of 1.15 as a $SrO/TiO_2$ molar ratio. Next, 0.0016 mol of tartaric acid was added to adjust a $TiO_2$ concentration to 0.195 mol/L. Next, a mixed solution of metatitanic acid and strontium chloride was heated to 90° C. with stirring and mixing, 148 ml of 3 mol/L of an aqueous sodium hydroxide solution was added for 20 hours, and thereafter, stirring was continued at 95° C. for 1 hour, and the reaction was completed. The reaction slurry was cooled to 50° C., 6 mol/L of hydrochloric acid was added up to pH 5.0, and stirring was continued for 1 hour. The supernatant was removed, and 50 L of pure water was added to perform washing by decantation.

The slurry including the precipitation was adjusted to 50° C., 6 mol/L of hydrochloric acid was added to adjust the pH to 2.5, then 2.0% by mass of isobutyltrimethoxysilane was added with respect to solids, and stirring was continuously maintained for 14 hours. 5 mol/L of an aqueous sodium hydroxide solution was added to adjust the pH to 8.0, stirring was continued for 1 hour, and filtration and washing was performed to obtain a cake, which was dried for 8 hours under an atmosphere at 120° C., thereby obtaining strontium titanate particles 9.

Preparation Example of Strontium Titanate Particles 10

Desulfurization and peptization treatment of metatitanic acid was performed in the same manner as in the Preparation Example of strontium titanate particles 1.

To peptized metatitanic acid slurry which was subjected to desulfurization and peptization, an aqueous strontium chloride solution was added by an amount of 1.15 as a $SrO/TiO_2$ molar ratio. Next, 0.0008 mol of tartaric acid was added to adjust a $TiO_2$ concentration to 0.151 mol/L. Next, a mixed solution of metatitanic acid and strontium chloride was heated to 95° C. with stirring and mixing, then 148 ml of 3 mol/L of an aqueous sodium hydroxide solution was added for 24 hours, and thereafter, stirring was continued at 95° C. for 1 hour, and the reaction was completed. The reaction slurry was cooled to 50° C., and 6 mol/L of hydrochloric acid was added up to pH 5.0, and stirring was continued for 1 hour. The supernatant was removed, and 50 L of pure water was added to perform washing by decantation.

The slurry including the precipitation was adjusted to 50° C., 6 mol/L of hydrochloric acid was added to adjust the pH to 2.5, 2.0% by mass of isobutyltrimethoxysilane was added with respect to solids, and stirring was continuously maintained for 14 hours. 5 mol/L aqueous sodium hydroxide solution was added to adjust the pH to 8.0, stirring was continued for 1 hour, and filtration and washing was performed to obtain a cake, which was dried for 8 hours under an atmosphere at 120° C., thereby obtaining strontium titanate particles 10.

Preparation Example of Strontium Titanate Particles 11

Desulfurization and peptization treatment of metatitanic acid was performed in the same manner as in the Preparation Example of strontium titanate particles 1.

To peptized metatitanic acid slurry which was subjected to desulfurization and peptization, an aqueous strontium chloride solution was added by an amount of 1.15 as a $SrO/TiO_2$ molar ratio. Next, 0.0003 mol of tartaric acid was added to adjust a $TiO_2$ concentration to 0.151 mol/L. Next, a mixed solution of metatitanic acid and strontium chloride was heated to 95° C. with stirring and mixing, 148 ml of 3 mol/L of an aqueous sodium hydroxide solution was added for 24 hours, and thereafter, stirring was continued at 95° C. for 1 hour, and the reaction was completed. The reaction slurry was cooled to 50° C., and 6 mol/L of hydrochloric acid was added up to pH 5.0, and stirring was continued for 1 hour. The supernatant was removed, and 50 L of pure water was added to perform washing by decantation.

The slurry including the precipitation was adjusted to 50° C., 5 mol/L of an aqueous sodium hydroxide solution was added to adjust the pH 6.5, stirring was continued for 1 hour, and filtration and washing was performed to obtain a cake, which was dried for 8 hours under an atmosphere at 120° C., thereby obtaining strontium titanate particles 11.

Preparation Example of Strontium Titanate Particles 12

Metatitanic acid slurry obtained by hydrolyzing an aqueous titanyl sulfate solution was washed with an aqueous alkaline solution. Next, to the metatitanic acid slurry, hydrochloric acid was added to adjust the pH to 0.65, thereby obtaining a titania sol dispersion. To the titania sol dispersion, NaOH was added, pH of the dispersion was adjusted to 4.5, and washing was repeated until the electrical conductivity of a supernatant is 70 μS/cm.

An octahydrate of strontium hydroxide in a molar amount of 0.97 times the molar amount of the metatitanic acid slurry was added to a reaction container made of stainless steel, and nitrogen gas was substituted. In addition, distilled water was added up to 0.5 mol/L in terms of $TiO_2$. The slurry was heated to 83° C. at 6.5° C./hr under a nitrogen atmosphere, and when the temperature reached 83° C., the reaction was performed for 6 hours. The thus obtained precipitation was washed by decantation.

The slurry including the precipitation was adjusted to 40° C., hydrochloric acid was added to adjust the pH to 2.5, 4.0% by mass of isobutyltrimethoxysilane was added with respect to solids, and stirring was continuously maintained for 10 hours. 5 mol/L of a sodium hydroxide solution was added to adjust the pH to 6.5, stirring was continued for 1 hour, and filtration and washing was performed to obtain a cake, which was dried for 8 hours under an atmosphere at 120° C., thereby obtaining strontium titanate particles 12.

Preparation Example of Strontium Titanate Particles 13

Metatitanic acid slurry obtained by hydrolyzing an aqueous titanyl sulfate solution was washed with an aqueous alkaline solution. Next, to slurry of metatitanic acid, hydrochloric acid was added to adjust the pH to 0.65, thereby obtaining a titania sol dispersion. To the titania sol dispersion, NaOH was added, and pH of the dispersion was adjusted to 4.5, and washing was repeated until the electrical conductivity of the supernatant is 70 μS/cm.

A strontium hydroxide octahydrate in a molar amount of 0.97 times the molar amount of the metatitanic acid was added to a reaction container made of stainless steel, and nitrogen gas was substituted. In addition, distilled water was added up to 0.5 mol/L in terms of $SrTiO_3$. The slurry was heated to 83° C. at 6.5° C./hr under a nitrogen atmosphere, and after the temperature reached 83° C., the reaction was performed for 6 hours. After the reaction, the temperature was cooled to room temperature, the supernatant was removed, and washing was repeated with pure water.

The slurry including the precipitation was adjusted to 40° C., hydrochloric acid was added to adjust the pH to 2.5, 5.0% by mass of isobutyltrimethoxysilane was added with respect to solids, and stirring was continuously maintained for 10 hours. 5 mol/L of sodium hydroxide solution was added to adjust the pH to 6.5, stirring was continued for 1 hour, and filtration and washing was performed to obtain a cake, which was dried for 8 hours under an atmosphere at 120° C., thereby obtaining strontium titanate particles 13.

Preparation Example of Strontium Titanate Particles 14

The metatitanic acid slurry obtained by hydrolyzing an aqueous titanyl sulfate solution was washed with an aqueous alkaline solution. Next, to the slurry of metatitanic acid, hydrochloric acid was added to adjust the pH to 0.8, thereby obtaining a titania sol dispersion. To the titania sol dispersion, NaOH was added, the pH of the dispersion was adjusted to 5.0, and washing was repeated until the electrical conductivity of the supernatant was 70 μS/cm.

A strontium hydroxide octahydrate in a molar amount of 0.95 times the molar amount of the metatitanic acid slurry was added to a reaction container made of stainless steel, and nitrogen gas was substituted. In addition, distilled water was added up to 0.7 mol/L in terms of $SrTiO_3$. Under a nitrogen atmosphere, slurry was heated to 65° C. at 8° C./hr, and after the temperature reached 65° C., the reaction was performed for 5 hours. After the reaction, the temperature was cooled to room temperature, the supernatant was removed, washing was repeated with pure water, and thereafter, filtration was performed with a Nutsche filter. The thus-obtained cake was dried, and further, sintered at 1000° C.

After sintering, pure water was added to form a slurry, which was adjusted to 40° C., hydrochloric acid was added to adjust the pH to 2.5, 2.0% by mass of isobutyltrimethoxysilane with respect to solids was added, and stirring was continuously maintained for 10 hours. 5 mol/L of sodium hydroxide solution was added to adjust the pH to 6.5, stirring was continued for 1 hour, and filtration and washing was performed to obtain a cake, which was dried for 8 hours under an atmosphere at 120° C., thereby obtaining strontium titanate particles 14.

Preparation Example of Strontium Titanate Particles 15

600 g of strontium carbonate and 300 g of titanium oxide was wet-mixed for 9 hours with a ball mill, and filtered and dried. This mixture was molded with a pressure of 5 kg/cm$^2$, and calcined at a temperature of 1100° C. for 8 hours. The obtained strontium titanate was pulverized by a pulverizer using jet stream, and a wind power classifier was used to perform classification so that the particle diameter was uniform to some extent. Thereafter, the particles were dispersed in water, more precise classification was performed with a centrifuge, drying was performed, and pulverizing treatment was performed, thereby obtaining a base material of strontium titanate particles.

Pure water was added to this base material to form a slurry, which was adjusted to 40° C., hydrochloric acid was added to adjust the pH to 2.5, 2.0% by mass of isobutyltrimethoxysilane was added with respect to solids, and stirring was continuously maintained for 10 hours. 5 mol/L of the aqueous sodium hydroxide solution was added to adjust the pH to 6.5, stirring was continued for 1 hour, and filtration and washing was performed to obtain a cake, which was dried for 8 hours under an atmosphere at 120° C., thereby obtaining strontium titanate particles 15. The particles were polyhedral strontium titanate particles having a shape close to a spherical shape.

TABLE 1

| Strontium titanate particles | Surface treatment agent: Treated species | Surface treatment agent: Treated amount (% by mass) | Da (nm) | Ds | CV value | Degree of wettability (% by volume) | BET specific surface area (m$^2$/g) | $SrO/TiO_2$ molar ratio |
|---|---|---|---|---|---|---|---|---|
| 1 | Isobutyltrimethoxysilane | 4.0 | 93 | 2.1 | 0.05 | 72 | 75 | 0.78 |
| 2 | Isobutyltrimethoxysilane | 3.0 | 124 | 3.2 | 0.05 | 67 | 73 | 0.76 |
| 3 | Isobutyltrimethoxysilane | 3.0 | 121 | 1.5 | 0.02 | 69 | 73 | 0.78 |
| 4 | Isobutyltrimethoxysilane | 3.0 | 118 | 4.0 | 0.07 | 70 | 74 | 0.78 |
| 5 | Isobutyltrimethoxysilane | 7.0 | 65 | 1.6 | 0.05 | 71 | 78 | 0.77 |
| 6 | Isobutyltrimethoxysilane | 10.0 | 32 | 0.6 | 0.04 | 69 | 81 | 0.77 |
| 7 | 50 cSt silicone oil | 10.0 | 32 | 1.0 | 0.06 | 43 | 82 | 0.77 |
| 8 | — | — | 32 | 1.1 | 0.07 | 0 | 83 | 0.77 |
| 9 | Isobutyltrimethoxysilane | 2.0 | 187 | 5.0 | 0.05 | 63 | 60 | 0.80 |
| 10 | Isobutyltrimethoxysilane | 2.0 | 215 | 6.4 | 0.06 | 62 | 48 | 0.81 |
| 11 | — | — | 215 | 7.0 | 0.07 | 0 | 49 | 0.81 |
| 12 | Isobutyltrimethoxysilane | 4.0 | 80 | 3.5 | 0.09 | 70 | 72 | 0.88 |
| 13 | Isobutyltrimethoxysilane | 5.0 | 100 | 5.1 | 0.10 | 69 | 15 | 0.95 |
| 14 | Isobutyltrimethoxysilane | 2.0 | 430 | 40.5 | 0.19 | 50 | 18 | 1.05 |
| 15 | Isobutyltrimethoxysilane | 2.0 | 250 | 21.0 | 0.17 | 60 | 27 | 1.01 |

Preparation Example of Silica Fine Particles 1

The base material of silica fine particles having a number average particle diameter of 15 nm and a BET specific surface area of 200 $m^2/g$ was surface-treated with 100 cSt of silicone oil. As shown in Table 2, the BET specific surface area after surface treatment was 180 $m^2/g$.

<Silica Fine Particles 2 and 3>

Surface-treated silica fine particles 2 and 3 having the number average particle diameter and the BET specific surface area as shown in Table 2 were prepared.

TABLE 2

| Type of external additive | Number average particle diameter (nm) | BET specific surface area ($m^2/g$) | Surface treatment |
|---|---|---|---|
| Silica fine particles 1 | 15 | 180 | Oil treatment |
| Silica fine particles 2 | 20 | 81 | HMDS + oil treatment |
| Silica fine particles 3 | 10 | 214 | Oil treatment |

* HMDS: hexamethyldisilazane

The toner particles were manufactured as follows. The physical properties of the obtained toner particles 1 to 4 are shown in Table 3.

Preparation Example of Toner Particles 1

710 parts of ion exchange water and 850 parts of 0.1 mol/L of an aqueous $Na_3PO_4$ solution were added to four-neck container, stirring was performed at 200 $s^{-1}$ using a high speed stirrer, T.K. homomixer (manufactured by Tokushu Kika Kogyo Co., Ltd.), while the temperature was maintained at 60° C. 68 parts of 1.0 mol/L of an aqueous $CaCl_2$ solution was slowly added thereto, thereby preparing an aqueous dispersion medium including a dispersion stabilizer.

| | |
|---|---|
| Styrene | 125 parts |
| n-Butyl acrylate | 35 parts |
| Copper phthalocyanine pigment (Pigment Blue 15:3) | 6 parts |
| Polyester resin 1 (terephthalic acid-propylene oxide modified bisphenol A (2 mol adduct) copolymer, acid value: 10 mgKOH/g, glass transition temperature (Tg): 70° C., weight average molecular weight (Mw): 10500) | 10 parts |
| Fischer-Tropsch wax (melting point: 78° C.) | 15 parts |

The above materials were stirred for 3 hours using an attritor (manufactured by NIPPON COKE & ENGINEERING CO., LTD.), and each component was dispersed in a polymerizable monomer to prepare a monomer mixture.

To the monomer mixture, 20.0 parts of 1,1,3,3-tetramethylbutylperoxy 2-ethylhexanoate (toluene solution 50%) which is a polymerization initiator was added to prepare a polymerizable monomer composition.

The polymerizable monomer composition was added to an aqueous dispersion medium, granulation was performed for 5 minutes while a rotational speed of the stirrer was maintained at 167 $s^{-1}$. Thereafter, a high speed stirrer was changed to a propeller type stirrer, the internal temperature was raised to 70° C., and the reaction was performed for 6 hours with slow stirring.

Subsequently, the temperature in the container was raised to 80° C. and maintained for 4 hours, and then cooled, thereby obtaining slurry. To the container containing the slurry, dilute hydrochloric acid was added to remove a dispersion stabilizer. In addition, filtering off, washing, and drying were performed to obtain toner particles 1 having a weight average particle diameter of 6.8 The average circularity and Tg of toner particles 1 are shown in Table 3.

Preparation Example of Toner Particles 2

To a four-neck container, 710 parts of ion exchange water and 850 parts of 0.1 mol/L of an aqueous $Na_3PO_4$ solution were added, stirring was performed at 200 $s^{-1}$ using a high speed stirrer, T.K. homomixer, while the temperature was maintained at 60° C. 68 parts of 1.0 mol/L of an aqueous $CaCl_2$) solution was slowly added thereto, thereby an aqueous dispersion medium including a dispersion stabilizer.

| | |
|---|---|
| Styrene | 125 parts |
| n-Butyl acrylate | 35 parts |
| Copper phthalocyanine pigment (Pigment Blue 15:3) | 8 parts |
| Polyester resin 1 (terephthalic acid-propylene oxide modified bisphenol A (2 mol adduct) copolymer, acid value: 10 mgKOH/g, glass transition temperature (Tg): 70° C., weight average molecular weight (Mw): 10500) | 10 parts |
| Fischer-Tropsch wax (melting point: 78° C.) | 15 parts |

The above materials were stirred for 3 hours using an attritor, and each component was dispersed in the polymerizable monomer to prepare a monomer mixture.

To the monomer mixture, 20.0 parts of 1,1,3,3-tetramethylbutylperoxy 2-etehylhexanoate (toluene solution 50%) was added to prepare a polymerizable monomer composition.

The polymerizable monomer composition was added to an aqueous dispersion medium, and granulation was performed for 5 minutes while the rotational speed of the stirrer was maintained at 158 $s^{-1}$. Thereafter, the high speed stirrer was changed to a propeller type stirrer, the internal temperature was raised to 65° C., and the reaction was performed for 6 hours with slow stirring.

Subsequently, the temperature in the container was raised to 80° C. and maintained for 4 hours, and then cooled, thereby obtaining slurry. To the container containing the slurry, dilute hydrochloric acid was added to remove a dispersion stabilizer. In addition, filtering off, washing, and drying were performed to obtain toner particles 2 having a weight average particle diameter of 6.6 The average circularity and Tg of toner particles 2 are shown in Table 3.

Preparation Example of Toner Particles 3

Preparation Example of Polyester Resin 1

In a reaction vessel equipped with a cooling pipe, a stirrer, and a nitrogen introduction pipe, the following materials were weighed:

| | |
|---|---|
| Terephthalic acid | 23.0 parts |
| Anhydrous trimellitic acid | 1.0 parts |
| Polyoxypropylene (2.2)-2,2-bis(4-hydroxyphenyl)propane | 76.0 parts |
| Titanium dihydroxybis(triethanolaminate) | 0.1 parts |

Thereafter, heating to 200° C. was performed, the reaction was performed for 9 hours while removing water produced by introducing nitrogen, and thereafter, pressure was reduced to 10 mmHg and the reaction was performed for 1 hour, thereby synthesizing polyester resin 1. Polyester resin 1 obtained by GPC had a molecular weight of a weight average molecular weight (Mw) of 6,200, a number average molecular weight (Mn) of 2,400, and a peak molecular weight (Mp) of 2,750, and a glass transition temperature of 50° C., and a softening point of 94° C.

The following materials were mixed with an FM mixer (FM-75 type, manufactured by NIPPON COKE & ENGINEERING CO., LTD.), and then kneaded under the conditions of a rotational speed of 3.3 $s^{-1}$ and a kneading resin temperature of 110° C., using a twin-screw kneader (manufactured by Ikegai Corp. PCM-30 type).

| | |
|---|---|
| Polyester resin 1 | 100.0 parts |
| Copper phthalocyanine pigment (Pigment Blue 15:3) | 8.0 parts |
| Fischer-Tropsch wax (melting point: 78° C.) | 5.0 parts |
| 3,5-Di-t-butyl aluminum salicylate compound | 0.5 parts |

The thus-obtained kneaded product was cooled, and coarsely crushed to 1 mm or less with a hammer mill, thereby obtaining a coarsely crushed product. The obtained coarsely crushed product was finely pulverized with a mechanical pulverizer (T-250 manufactured by FREUND-TURBO CORPORATION). In addition, the obtained finely pulverized powder was classified using a multi-division classifier using a Coanda effect, thereby obtaining negatively chargeable toner particles 3 having a weight average particle diameter of 6.9 The average circularity and Tg of toner particles 3 are shown in Table 3.

Preparation Example of Toner Particles 4

Preparation was performed in the same manner as toner particles 3, except that the added amount of the coloring agent is changed from 8.0 parts to 4.0 parts, thereby obtaining negatively chargeable toner particles 4 having a weight average particle diameter of 6.6 μm. The average circularity and Tg of toner particles 4 were shown in Table 3.

TABLE 3

| | Average circularity | Tg (° C.) |
|---|---|---|
| Toner particles 1 | 0.978 | 61.3 |
| Toner particles 2 | 0.972 | 60.2 |
| Toner particles 3 | 0.955 | 51.2 |
| Toner particles 4 | 0.954 | 52.1 |

Preparation Example of Toner 1

With respect to 100 parts of the obtained toner particles 1, 1.5 parts of strontium titanate particles 1, and 0.5 parts of silica fine particles 1 were externally mixed by FM10C (manufactured by NIPPON COKE & ENGINEERING CO., LTD.).

The external addition condition was performed with an introduced amount of toner particles of 1.8 kg, a rotational speed of 60 $s^{-1}$, and an external addition time of 12 minutes. Thereafter, sieving was performed with a mesh having a pore size of 200 μm to obtain toner 1. The physical properties of toner 1 are shown in Table 4.

Example 1

The thus-obtained toner 1 was used to perform the following evaluation. The evaluation results are shown in Table 5.

<Analysis of Adhesion State of Strontium Titanate Particles>

The thus-obtained toner 1 was used to perform evaluation for change of adhesion state of the strontium titanate particles.

The surface of toner 1 was observed using Hitachi Ultra-high Resolution emission scanning electron microscope S-4800 (manufactured by Hitachi High-Technologies Corporation). As the observation condition, one toner is observed at a magnification of 30,000 times. In addition, in order to perform image processing of inorganic fine particles, an acceleration voltage at the time of observation is adjusted to a little higher (for example, 5 kV) to perform observation with a reflection electron image, whereby the strontium titanate particles are represented with high luminance and the toner particles are represented with low luminance, which is thus preferred.

In the reflection electron image of this toner, as shown in FIGURE, a maximum length of a subtense of the toner particles is segment A, and two segments which are parallel to segment A and 1.0 μm away from segment A are segment B and segment C. In addition, a segment which passes through a midpoint of segment A and is orthogonal to segment A is segment D. In addition, two segments which are parallel to segment D and 1.0 μm away from segment D are segment E and segment F. Four regions which are formed by segment A and segments B, C, D, E, and F and squares, a side of which has a length of 1.0 are determined.

The number of strontium titanate particles present in four regions is counted, respectively, and the existence number of strontium titanate particles present in each side of region of 1.0 μm was calculated. This is shown in "Initial adhesion number of strontium titanate particles" in Table 4. This work was performed for 50 toners, and the average value was calculated. Then, when the strontium titanate particles are present on segments A, B, C, D, E, and F, the numerical values in the regions are not used at the time of calculation.

In addition, 3 g of toner 1 was weighed, added to a 50 cc plastic bottle, and shaken at a rotational speed of 2.5 $s^{-1}$ for 30 minutes with a shaker (Model-YS-8D, manufactured by YAYOI CO., LTD.), thereby obtaining a simulatively deteriorated toner. For the toner after being shaken also, the existence number of strontium titanate particles on the surface of the toner was calculated in the same manner in the above. These are shown in Table 4 in the section of "the adhesion number of strontium titanate particles after shaking for 30 minutes". In addition, the rates of change of adhesion number of strontium titanate particles initially and after shaking 30 minutes are calculated by the following Equation. The evaluation results are shown in Table 4.

$$\text{Rate of change}=(|\text{initial rate}-\text{rate after shaking for 30 minutes}|/\text{initial rate})\times 100$$

In addition, obtained toner 1 was used to perform the following evaluation. The evaluation results are shown in Table 5.

<Evaluator>

A laser beam printer, HP Color LaserJet EnterpriseM651n was modified so that the printer is operated with equipment of only one color process cartridge, and a transfer current can be manually changed, thereby performing evaluation. As the evaluation paper, CS-680 sold by Canon Marketing Japan Inc. was used. The toner was charged in the cartridge.

For long-term use, evaluation was performed under a normal temperature and normal humidity environment (a temperature at 23° C. and a relative humidity of 50%) and a low temperature and low humidity environment (a temperature at 10° C. and a relative humidity of 14%) which are easily affected by chargeability. Under the low humidity environment, chargeability of the toner was high, while moisture of the evaluation paper was also low and resistance was high, and thus, the condition is strict about transferability.

For long-term use, in a mode which was set so that a horizontal line pattern having a printing rate of 2% is done at 2 sheets/1 work, and the machine stops once between the works and then the next work starts, image formation test of total 15,000 sheets was performed. Evaluation was performed initially and after forming 15,000 sheets of images.

<Image Density>

The image density was measured by printing out a solid image of a circle of 5 mm and measuring a reflection density with a reflection densitometer, X-Rite 500 series (manufactured by Videojet X-Rite K.K.). Under the both environments of normal temperature and normal humidity, and low temperature and low humidity, and further initially and after forming 15,000 sheets of image, evaluation was performed.

<Gloss Paper Fogging>

Solid white sheets were passed, a minimum value of a white background reflection density in a whole white image is set as Ds, an reflection average concentration of a transfer material before forming image is set as Dr, and Dr-Ds is set as a fogging value. As evaluation paper, glossy paper (HP laser Brochure Paper 200 g paper, manufactured by HP) was used. For the measurement of the reflection density, a reflection densitometer (refractometer model TC-6DS, manufactured by Tokyo Denshoku CO., LTD.) was used, and as a filter, an Amberlite filter was used. A lower numerical value represents a better the fogging level. Under the normal temperature and normal humidity environment, evaluation was performed both initially and after forming 15,000 sheets of images.

<Transfer Residual Concentration>

Evaluation of transferability was performed under a low temperature and low humidity environment which is conditionally difficult. In addition, the transferability is affected also by a transfer current, when the transferability is stable for the transfer current, transferability as the toner is good.

As an evaluation method, in a 5 mm circle image, gradation was adjusted so that the reflection density on the paper is 1.40 or more. The image was identically printed out with the adjusted gradation to transfer the image of a 5 mm circle, and when a transfer residual toner remains on an electrostatic image support, driving of a motor was stopped. The transfer residual toner on the electrostatic image support was taped, and the tape was attached on the paper (CS-680) which was not used. The concentration of the tape was measured by measuring the reflection density with X-Rite 500 series, thereby measuring the concentration of the transfer residual toner. Low reflection density represents good transferability.

The measurement was performed by changing the transfer current to 8 μA, 11 μA, and 14 μA, both initially and after forming 15,000 sheets of images. In addition, non-uniformity by the transfer current was evaluated by a standard deviation of a transfer residual concentration in each of the transfer current.

<Halftone Streak>

Uniformity of a halftone concentration was evaluated after forming 15,000 sheets of images under a low temperature and low humidity environment.

A halftone image having a reflection density of 0.60 was printed out, the reflection density of the obtained image was measured at 5 points in a length direction, and a concentration difference thereof was obtained, thereby evaluating a concentration deviation of the halftone image. Here, the concentration deviation refers to a concentration deviation of a streak shape occurring in the same direction of the printing out direction of paper. The evaluation criteria are shown below. At rank C or higher, the level has the effect of the present disclosure.

A: difference in reflection density less than 0.05

B: difference in reflection density equal to or more than 0.05 and less than 0.10

C: difference in reflection density equal to or more than 0.10 and less than 0.15

D: difference in reflection density of 0.15 or more

Preparation Example of Toners 2 to 16, and Comparative Toners 1 to 5

Toners 2 to 16 and comparative toners 1 to 5 were obtained in the same manner as in Preparation Example of toner 1, except that in the Preparation Example of toner 1, the type and added amounts of toner particles and strontium titanate particles were changed as shown in Table 4.

Examples 2 to 16 and Comparative Examples 1 to 5

Evaluation was performed in the same manner as in Example 1. The evaluation results are shown in Table 5.

TABLE 4

| | | External additive | | | | | Physical properties of toner | | | |
|---|---|---|---|---|---|---|---|---|---|---|
| | | | | | | | Coverage rate of | Adhesion number of strontium titanate | | |
| | Toner particle Type | Strontium titanate particle | Added amount (part) | Type of silica fine particle | Added amount (part) | External addition condition | strontium titanate particles (%) | Initial | After shaking for 30 minutes | Rate of change |
| Toner 1 | 1 | 1 | 1.5 | 1 | 0.5 | 60 $s^{-1}$ 12 min | 5.9 | 8.2 | 11.0 | 34 |
| Toner 2 | 1 | 2 | 1.5 | 1 | 0.5 | 60 $s^{-1}$ 12 min | 4.4 | 4.5 | 5.0 | 11 |
| Toner 3 | 1 | 3 | 1.5 | 1 | 0.5 | 60 $s^{-1}$ 12 min | 4.6 | 4.8 | 2.4 | 50 |
| Toner 4 | 1 | 4 | 1.5 | 1 | 0.5 | 60 $s^{-1}$ 12 min | 5.6 | 4.2 | 3.1 | 26 |
| Toner 5 | 1 | 5 | 1.0 | 2 | 0.5 | 60 $s^{-1}$ 12 min | 6.8 | 22.3 | 20.5 | 8 |
| Toner 6 | 1 | 6 | 0.5 | 2 | 0.5 | 60 $s^{-1}$ 12 min | 6.3 | 71.3 | 65.0 | 9 |
| Toner 7 | 1 | 6 | 0.2 | 2 | 0.5 | 60 $s^{-1}$ 12 min | 2.3 | 34.3 | 24.1 | 30 |
| Toner 8 | 1 | 6 | 1.0 | 2 | 0.5 | 60 $s^{-1}$ 12 min | 9.6 | 97.0 | 71.6 | 26 |
| Toner 9 | 1 | 6 | 2.0 | 2 | 0.5 | 60 $s^{-1}$ 12 min | 19.5 | 184.2 | 152.0 | 17 |

TABLE 4-continued

| | | External additive | | | | | Physical properties of toner | | | |
|---|---|---|---|---|---|---|---|---|---|---|
| | | | | | | | Coverage rate of strontium titanate particles (%) | Adhesion number of strontium titanate | | |
| | Toner particle Type | Strontium titanate particle | Added amount (part) | Type of silica fine particle | Added amount (part) | External addition condition | | Initial | After shaking for 30 minutes | Rate of change |
| Toner 10 | 1 | 7 | 2.0 | 2 | 0.5 | 60 $s^{-1}$ 12 min | 19.5 | 178.3 | 148.2 | 17 |
| Toner 11 | 1 | 8 | 2.0 | 2 | 0.5 | 60 $s^{-1}$ 12 min | 19.5 | 185.3 | 143.8 | 22 |
| Toner 12 | 1 | 9 | 5.0 | 3 | 0.5 | 60 $s^{-1}$ 12 min | 11.2 | 3.7 | 2.6 | 30 |
| Toner 13 | 1 | 10 | 5.0 | 3 | 0.5 | 60 $s^{-1}$ 12 min | 10.3 | 3.2 | 2.1 | 34 |
| Toner 14 | 2 | 11 | 5.0 | 3 | 0.5 | 60 $s^{-1}$ 12 min | 10.5 | 2.8 | 2.0 | 29 |
| Toner 15 | 3 | 11 | 5.0 | 3 | 0.5 | 60 $s^{-1}$ 12 min | 10.5 | 3.5 | 1.7 | 51 |
| Toner 16 | 4 | 11 | 5.0 | 3 | 0.5 | 60 $s^{-1}$ 12 min | 10.5 | 3.0 | 1.4 | 53 |
| Toner 17 | 1 | 12 | 1.5 | 1 | 0.5 | 60 $s^{-1}$ 12 min | 11.0 | 8.6 | 2.1 | 76 |
| Toner 18 | 1 | 13 | 1.5 | 1 | 0.5 | 60 $s^{-1}$ 12 min | 10.0 | 12.9 | 2.6 | 80 |
| Toner 19 | 1 | 14 | 2.5 | 1 | 0.5 | 60 $s^{-1}$ 12 min | 5.0 | 0.5 | 0.2 | 60 |
| Toner 20 | 1 | — | — | 1 | 0.5 | 60 $s^{-1}$ 12 min | — | — | — | — |
| Toner 21 | 1 | 15 | 5.0 | 1 | 0.5 | 60 $s^{-1}$ 12 min | 9.6 | 2.9 | 0.4 | 86 |

TABLE 5

| | | Evaluation results under NN environment | | | | Evaluation results under LL environment | | | | |
|---|---|---|---|---|---|---|---|---|---|---|
| | | | | | | | Transfer residual concentration (initial) | | | |
| | Type of toner | Image density (initial) | Gloss paper fogging (initial) | Image density (after 15000 sheets) | Gloss paper fogging (after 15000 sheets) | Image density (initial) | 8 μA | 11 μA | 14 μA | Standard deviation of transfer residual concentration |
| Example 1 | 1 | 1.75 | 0.5 | 1.68 | 0.8 | 1.72 | 2.2 | 2.0 | 2.3 | 0.15 |
| Example 2 | 2 | 1.62 | 0.8 | 1.55 | 0.8 | 1.62 | 4.2 | 3.9 | 3.9 | 0.17 |
| Example 3 | 3 | 1.60 | 0.6 | 1.48 | 0.7 | 1.61 | 4.1 | 3.8 | 4.0 | 0.15 |
| Example 4 | 4 | 1.72 | 0.6 | 1.68 | 0.6 | 1.73 | 2.6 | 2.4 | 2.3 | 0.15 |
| Example 5 | 5 | 1.68 | 0.8 | 1.62 | 0.9 | 1.70 | 2.8 | 2.5 | 2.6 | 0.15 |
| Example 6 | 6 | 1.59 | 0.7 | 1.55 | 0.9 | 1.59 | 4.9 | 4.5 | 4.5 | 0.23 |
| Example 7 | 7 | 1.52 | 0.9 | 1.49 | 1.0 | 1.55 | 6.2 | 5.7 | 5.8 | 0.26 |
| Example 8 | 8 | 1.54 | 0.7 | 1.52 | 0.9 | 1.56 | 4.3 | 4.1 | 3.9 | 0.20 |
| Example 9 | 9 | 1.46 | 0.6 | 1.32 | 0.7 | 1.45 | 2.6 | 2.4 | 2.1 | 0.25 |
| Example 10 | 10 | 1.47 | 0.9 | 1.35 | 1.0 | 1.46 | 2.9 | 2.5 | 2.4 | 0.26 |
| Example 11 | 11 | 1.42 | 1.1 | 1.30 | 1.3 | 1.44 | 2.8 | 2.6 | 2.5 | 0.15 |
| Example 12 | 12 | 1.55 | 0.6 | 1.48 | 0.7 | 1.52 | 2.7 | 2.5 | 2.4 | 0.15 |
| Example 13 | 13 | 1.49 | 0.6 | 1.40 | 0.9 | 1.50 | 2.6 | 2.4 | 2.2 | 0.20 |
| Example 14 | 14 | 1.78 | 1.2 | 1.76 | 2.7 | 1.81 | 2.7 | 2.4 | 2.3 | 0.21 |
| Example 15 | 15 | 1.75 | 1.0 | 1.75 | 3.5 | 1.78 | 2.9 | 2.7 | 2.6 | 0.15 |
| Example 16 | 16 | 1.40 | 0.6 | 1.28 | 2.6 | 1.37 | 2.8 | 2.6 | 2.4 | 0.20 |
| Comparative Example 1 | 17 | 1.58 | 0.7 | 1.58 | 0.9 | 1.60 | 8.7 | 3.2 | 7.4 | 2.87 |
| Comparative Example 2 | 18 | 1.61 | 0.8 | 1.59 | 0.9 | 1.62 | 9.8 | 3.8 | 8.2 | 3.11 |
| Comparative Example 3 | 19 | 1.60 | 0.6 | 1.57 | 0.8 | 1.61 | 12.2 | 3.9 | 9.6 | 4.25 |
| Comparative Example 4 | 20 | 1.48 | 0.8 | 1.42 | 1.2 | 1.48 | 15.0 | 5.6 | 9.5 | 4.72 |
| Comparative Example 5 | 21 | 1.47 | 0.7 | 1.40 | 1.1 | 1.59 | 11.5 | 3.2 | 9.8 | 4.38 |

| | Evaluation results under LL environment | | | | | |
|---|---|---|---|---|---|---|
| | | Transfer residual concentration (after 15000 sheets) | | | | |
| | Image density (after 15000 sheets) | 8 μA | 11 μA | 14 μA | Standard deviation of transfer residual concentration | HT streak (after 15000 sheets) |
| Example 1 | 1.68 | 3.5 | 2.6 | 3.7 | 0.59 | A |
| Example 2 | 1.60 | 5.6 | 4.5 | 6.1 | 0.82 | B |
| Example 3 | 1.57 | 6.8 | 3.8 | 6.4 | 1.63 | B |
| Example 4 | 1.70 | 3.5 | 3.0 | 4.1 | 0.55 | B |
| Example 5 | 1.67 | 3.9 | 2.8 | 4.2 | 0.74 | A |
| Example 6 | 1.56 | 6.4 | 4.6 | 6.0 | 0.95 | A |
| Example 7 | 1.52 | 8.2 | 6.4 | 8.0 | 0.99 | A |

TABLE 5-continued

| | | | | | | |
|---|---|---|---|---|---|---|
| Example 8 | 1.50 | 7.2 | 5.4 | 6.7 | 0.93 | A |
| Example 9 | 1.29 | 4.2 | 3.3 | 4.8 | 0.75 | B |
| Example 10 | 1.28 | 3.9 | 3.6 | 4.9 | 0.68 | B |
| Example 11 | 1.29 | 4.4 | 3.1 | 5.0 | 0.97 | C |
| Example 12 | 1.48 | 4.6 | 2.5 | 5.6 | 1.58 | C |
| Example 13 | 1.42 | 9.5 | 6.6 | 9.1 | 1.57 | C |
| Example 14 | 1.80 | 8.0 | 6.3 | 8.0 | 0.98 | C |
| Example 15 | 1.78 | 11.2 | 6.4 | 10.2 | 2.53 | C |
| Example 16 | 1.25 | 10.2 | 6.4 | 9.6 | 2.04 | C |
| Comparative Example 1 | 1.26 | 16.2 | 8.0 | 13.6 | 4.19 | A |
| Comparative Example 2 | 1.31 | 15.3 | 7.8 | 12.1 | 3.76 | A |
| Comparative Example 3 | 1.15 | 18.0 | 7.6 | 14.5 | 5.29 | D |
| Comparative Example 4 | 1.05 | 21.3 | 9.2 | 14.2 | 6.08 | A |
| Comparative Example 5 | 1.18 | 19.5 | 7.4 | 14.0 | 6.06 | D |

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2018-036772, filed Mar. 1, 2018, which is hereby incorporated by reference herein in its entirety.

What is claimed is:

1. A toner comprising:

a toner particle; and an external additive, wherein the external additive contains a strontium titanate particle, a molar ratio of Sr to Ti of the strontium titanate particle is 0.81 or less, and when in a projected image of the strontium titanate particle photographed using a scanning electron microscope, a standard deviation of a distance from a center of gravity of the projected image to an outline of the projected image is Ds, and a circle-equivalent diameter of the projected image is Da, a value CV calculated by the following Equation (1) is 0.07 or less:

$$CV=Ds/(Da/2) \quad (1).$$

2. The toner according to claim 1, wherein the circle-equivalent diameter Da of the projected image of the strontium titanate particle is 20 nm or more and 200 nm or less.

3. The toner according to claim 1, wherein when a wettability of the toner with respect to a methanol/water mixed solvent is measured by using a transmissivity of light having a wavelength of 780 nm through the mixed solvent, a methanol concentration in the mixed solvent at the transmissivity of 50% is in the range of 40% by volume to 95% by volume.

4. The toner according to claim 1, wherein a coverage rate of a surface of the toner by the strontium titanate particle is 2.0% by area or more and 20.0% by area or less, as measured by an X-ray photoelectron spectrometer.

5. The toner according to claim 1, wherein an average circularity of the toner particle is 0.935 or more and 0.995 or less.

6. The toner according to claim 1, wherein a BET specific surface area of the strontium titanate particle is 50 $m^2/g$ or more and 100 $m^2/g$ or less.

* * * * *